US011692380B2

(12) United States Patent
Rickenbaugh et al.

(10) Patent No.: US 11,692,380 B2
(45) Date of Patent: Jul. 4, 2023

(54) WINDOW SASH LOCK AND TILT MECHANISM

(71) Applicant: Amesbury Group, Inc., Edina, MN (US)

(72) Inventors: Allen Rickenbaugh, Sioux Falls, SD (US); Tyler Welbig, Harrisburg, SD (US); Chad Kramer, Sioux Falls, SD (US); Gary E. Tagtow, Sioux Falls, SD (US)

(73) Assignee: Amesbury Group, Inc., Edina, MN (US)

( * ) Notice: Subject to any disclaimer, the term of this patent is extended or adjusted under 35 U.S.C. 154(b) by 185 days.

(21) Appl. No.: 17/104,181

(22) Filed: Nov. 25, 2020

(65) Prior Publication Data

US 2021/0156182 A1 May 27, 2021

Related U.S. Application Data

(60) Provisional application No. 62/939,976, filed on Nov. 25, 2019.

(51) Int. Cl.
*E05C 9/04* (2006.01)
*E05C 3/00* (2006.01)
(Continued)

(52) U.S. Cl.
CPC ..... *E05C 9/041* (2013.01); *E05C 1/004* (2013.01); *E05C 1/06* (2013.01); *E05C 3/004* (2013.01);
(Continued)

(58) Field of Classification Search
CPC ..... Y10T 292/0802; Y10T 292/0834; Y10T 292/0836; Y10T 292/084; Y10T 292/0846;
(Continued)

(56) References Cited

U.S. PATENT DOCUMENTS 48,856 A 7/1865 Westcott
309,300 A 12/1884 Hamilton
(Continued)

FOREIGN PATENT DOCUMENTS

AT 11490 U1 * 9/2010 ..... E05C 9/004
AU 2016102099 A4 * 2/2017 ..... B65D 90/008
(Continued)

OTHER PUBLICATIONS

Standard F2090-10, entitled "Standard Specification for Window Fall Prevention Devices With Emergency Escape (Egress) Release Mechanisms," printed Sep. 23, 2013, copyright ASTM International, West Conshohocken, PA, 12 pgs.
(Continued)

*Primary Examiner* — Kristina R Fulton
*Assistant Examiner* — Steven A Tullia
(74) *Attorney, Agent, or Firm* — Merchant & Gould P.C.

(57) ABSTRACT

A window lock system includes a sash lock and at least one tilt latch. The sash lock includes a first housing, a lever, a cam, a slide plate, and at least one actuator movable via the lever. The tilt latch includes a second housing configured to be slidably mounted on a window sash and an independent bolt slidingly coupled to the first end of the second housing. A drive bar couples the at least one actuator and the second housing together. The sash lock is movable between at least a locked position, an unlocked position, and a tilt position by rotating the lever. When the sash lock is in the tilt position, the at least one actuator retracts relative to the first housing and via the drive bar retracts the first end of the second housing of the tilt latch relative to a side surface of the window sash.

19 Claims, 12 Drawing Sheets

(51) Int. Cl.

| | |
|---|---|
| ***E05C 3/04*** | (2006.01) |
| ***E05C 1/00*** | (2006.01) |
| ***E05C 9/12*** | (2006.01) |
| ***E05C 1/06*** | (2006.01) |

(52) U.S. Cl.

CPC ..... *E05C 3/046* (2013.01); *E05C 9/12* (2013.01); *E05Y 2201/716* (2013.01); *E05Y 2201/722* (2013.01); *E05Y 2900/148* (2013.01)

(58) Field of Classification Search

CPC . E05C 9/041; E05C 1/004; E05C 1/06; E05C 3/004; E05C 3/046; E05C 9/12; E05C 9/04; E05C 9/18; E05C 9/1825; E05C 9/20; E05C 9/22; E05Y 2201/716; E05Y 2201/722; E05Y 2900/148; Y10S 292/20; Y10S 292/47

See application file for complete search history.

(56) References Cited

U.S. PATENT DOCUMENTS 389,217 A 9/1888 Glenn
534,185 A 2/1895 Winchester
636,325 A 11/1899 Eyster
976,777 A 11/1910 Brown
1,275,246 A 8/1918 Greenfield
1,485,382 A 3/1924 Foley
1,855,089 A 4/1932 Boothe
2,961,263 A * 11/1960 Ahlgren ..... E05C 1/06 292/DIG. 20
3,151,901 A 10/1964 Aldgren
3,767,241 A 10/1973 Orr
4,110,867 A 9/1978 Gwozdz
4,303,264 A * 12/1981 Uehara ..... E05C 9/04 292/7
4,923,230 A 5/1990 Simpson
5,090,750 A * 2/1992 Lindqvist ..... E05B 65/087 292/DIG. 20
5,172,520 A 12/1992 Hostetler et al.
5,174,617 A 12/1992 Huber et al.
5,244,238 A 9/1993 Lindqvist
5,248,174 A 9/1993 Matz et al.
5,301,989 A 4/1994 Dallmann et al.
5,475,945 A 12/1995 Baker
D371,502 S 7/1996 Morris
5,536,052 A 7/1996 Maier
5,553,903 A 9/1996 Prete et al.
5,575,116 A 11/1996 Carlson et al.
5,791,700 A 8/1998 Biro
5,806,900 A 9/1998 Bratcher et al.
5,901,499 A 5/1999 Delaske et al.
5,992,907 A 11/1999 Sheldon et al.
6,142,541 A * 11/2000 Rotondi ..... E05C 3/046 292/DIG. 20
6,247,342 B1 6/2001 Lilas
6,364,375 B1 4/2002 Szapucki et al.
6,484,444 B1 11/2002 Polowinczak
6,546,671 B2 * 4/2003 Mitchell ..... E05B 65/08 292/DIG. 20
6,565,133 B1 5/2003 Timothy
6,572,158 B2 6/2003 Szapucki et al.
6,817,142 B2 11/2004 Marshik
6,854,214 B2 2/2005 Polowinczak
6,871,451 B2 3/2005 Harger et al.
6,871,886 B2 * 3/2005 Coleman ..... E05C 3/046 292/DIG. 47
6,925,758 B2 8/2005 Pettit
6,957,513 B2 10/2005 Pettit et al.
7,010,946 B2 3/2006 Hahn
7,013,603 B2 3/2006 Eenigenburg et al.
7,159,908 B2 1/2007 Liang
7,322,619 B2 1/2008 Nolte
7,412,800 B2 8/2008 Maier
7,431,356 B2 10/2008 Liang et al.
7,455,333 B2 11/2008 Ookawara
7,481,470 B2 1/2009 Eenigenburg et al.
7,490,873 B1 * 2/2009 Rieke ..... E05B 65/0876 292/DIG. 47
7,494,164 B1 2/2009 Garries et al.
7,530,611 B2 5/2009 Liang et al.
7,559,588 B2 7/2009 Liang
7,588,271 B1 9/2009 Lawrence
7,600,796 B2 10/2009 Liang et al.
7,607,262 B2 10/2009 Pettit
7,637,544 B2 12/2009 Liang et al.
7,665,775 B1 * 2/2010 Miller ..... E05B 65/0841 292/DIG. 20
7,963,577 B2 6/2011 Wolf
7,976,077 B2 7/2011 Flory
8,020,904 B2 9/2011 Flory et al.
8,083,273 B2 12/2011 Yuan
8,132,369 B2 3/2012 Pettit et al.
8,205,920 B2 6/2012 Flory
8,235,430 B2 8/2012 Liang et al.
8,353,541 B2 * 1/2013 Minter ..... E05C 9/1808 292/137
8,360,484 B2 1/2013 Liang et al.
8,806,809 B1 8/2014 Lawrence
8,950,119 B2 2/2015 Piltinsgrud
8,955,255 B2 2/2015 DeBoer
9,074,389 B2 7/2015 Shimizu
9,163,437 B1 10/2015 Lawrence
9,234,374 B2 1/2016 Wolf
9,719,279 B2 * 8/2017 Subliskey ..... E05C 1/12
10,119,310 B2 11/2018 Liang
10,119,311 B2 11/2018 Piltinsgrud
10,704,297 B2 * 7/2020 Liang ..... E05C 1/12
2003/0084614 A1 5/2003 Pettit et al.
2003/0110698 A1 * 6/2003 Polowinczak ..... E05C 9/00 49/446
2003/0110699 A1 6/2003 Eenigenburg et al.
2003/0167694 A1 9/2003 Liang
2003/0205903 A1 * 11/2003 Kelley ..... E05B 65/0876 292/241
2004/0168370 A1 * 9/2004 Pettit ..... E05C 9/00 49/185
2004/0200150 A1 10/2004 Kelley et al.
2004/0221513 A1 11/2004 Pettit
2005/0011131 A1 1/2005 Liang et al.
2005/0016067 A1 1/2005 Pettit et al.
2005/0146143 A1 7/2005 Lutfallah
2005/0229511 A1 10/2005 Balbo Di Vinadio
2006/0192391 A1 8/2006 Pettit
2006/0207181 A1 9/2006 Polowinczak et al.
2007/0180770 A1 8/2007 Flory et al.
2007/0209281 A1 * 9/2007 Flory ..... E05B 63/14 49/183
2007/0222233 A1 9/2007 Liang et al.
2007/0222234 A1 9/2007 Liang et al.
2007/0246953 A1 10/2007 Liang et al.
2008/0001413 A1 * 1/2008 Lake ..... E05C 9/22 292/138
2008/0079268 A1 4/2008 Liang et al.
2008/0127568 A1 6/2008 Liang et al.
2008/0150300 A1 6/2008 Harger et al.
2009/0019779 A1 1/2009 Nakanishi et al.
2009/0096220 A1 4/2009 Lutfallah
2009/0206616 A1 8/2009 Liang et al.
2009/0241429 A1 10/2009 Polowinczak et al.
2010/0050528 A1 3/2010 Pettit et al.
2010/0071269 A1 3/2010 Isley
2010/0132263 A1 6/2010 Flory
2010/0218425 A1 * 9/2010 Nolte ..... E05B 53/003 49/185
2010/0281780 A1 11/2010 Liang et al.
2010/0300000 A1 12/2010 Liang et al.
2011/0012373 A1 * 1/2011 Ramsauer ..... E05C 9/043 292/138
2011/0163555 A1 7/2011 Watts
2011/0192089 A1 8/2011 Barton et al.
2012/0124911 A1 5/2012 Hagemeyer et al.

(56) References Cited

U.S. PATENT DOCUMENTS

| | | | | |
|---|---|---|---|---|
| 2012/0144752 | A1 | 6/2012 | Piltinsgrud | |
| 2012/0167475 | A1 | 7/2012 | Sopkowiak et al. | |
| 2013/0214545 | A1* | 8/2013 | Wolf | E05C 3/046 292/241 |
| 2013/0283695 | A1* | 10/2013 | Hollermann | E06B 7/02 49/506 |
| 2015/0113880 | A1 | 4/2015 | Piltinsgrud | |
| 2015/0330121 | A1 | 11/2015 | Liang et al. | |
| 2016/0060921 | A1 | 3/2016 | Liang | |
| 2016/0069108 | A1* | 3/2016 | Liang | E05B 9/08 292/165 |
| 2017/0152688 | A1 | 6/2017 | Liang | |
| 2018/0058118 | A1* | 3/2018 | Minter | E05C 9/22 |
| 2019/0032378 | A1 | 1/2019 | Piltinsgrud | |
| 2021/0156182 | A1* | 5/2021 | Rickenbaugh | E05C 9/041 |

FOREIGN PATENT DOCUMENTS

| | | | | | |
|---|---|---|---|---|---|
| CA | 3010375 | A1 | * | 12/2018 | E05B 53/003 |
| CN | 112696100 | A | * | 4/2021 | E05B 15/10 |
| DE | 2252177 | A1 | * | 10/1972 | E05C 9/041 |
| DE | 19742512 | A1 | * | 4/1999 | E05C 9/006 |
| DE | 202006004589 | U1 | * | 8/2006 | E05C 9/1825 |
| DE | 202009005345 | U1 | * | 7/2009 | E05B 7/00 |
| DE | 202012010979 | U1 | * | 1/2013 | E05B 15/0053 |
| EP | 1717395 | A1 | * | 11/2006 | E05C 9/041 |
| EP | 2096243 | A1 | * | 9/2009 | E05C 1/06 |
| FR | 1570029 | A | * | 4/1968 | E05B 15/10 |
| FR | 2458655 | A1 | * | 6/1979 | E05C 9/004 |
| FR | 2609089 | A1 | * | 12/1986 | E05B 15/0053 |
| FR | 2744164 | A1 | * | 8/1997 | E05C 1/04 |
| GB | 2253241 | A | * | 9/1992 | E05C 9/041 |
| GB | 2423792 | A | * | 9/2006 | E05C 9/041 |
| GB | 2438627 | A | * | 12/2007 | E05C 9/021 |
| GB | 2499802 | A | * | 9/2013 | E05B 65/0876 |
| KR | 20090012620 | U | * | 6/2008 | E05C 9/006 |
| WO | WO-2004083575 | A1 | * | 9/2004 | E05C 9/026 |

OTHER PUBLICATIONS

Truth Hardware, 19 Fusion System, accessed online on Jun. 26, 2014, 12 pgs.

* cited by examiner

WINDOW SASH LOCK AND TILT MECHANISM

CROSS-REFERENCE TO RELATED APPLICATIONS

This application claims the benefit of and priority to U.S. Provisional Patent Application No. 62/939,976, filed Nov. 25, 2019, which is incorporated by reference herein in its entirety.

INTRODUCTION

Window sash locks prevent vertical movement of a window sash by selectively engaging a rotatable cam disposed in a first window sash with a fixed keeper disposed on a second window sash. Typically, window sash locks are disposed proximate a central portion of a window sash. Tilt latches allow a window sash to be tilted inward to be cleaned and/or replaced. Typically, tilt latches are disposed proximate sides of the window sash and include a tab to pull a bolt from engagement with the window jamb. Once the bolt is disengaged, the window sash can be tilted. In some known examples, the window sash lock and tilt latch systems are combined.

Additionally, the distance a window sash may open may be limited by the use of a window opening limit device (WOLD), also known as a window opening control device (WOCD). These WOCDs typically are installed in one window sash of a double hung window (or other sliding window) and project from the window sash when activated. As the opposite window sash is opened, the WOCD limits the distance of the opening, either for safety (to prevent inadvertent egress of a child) and/or security (to prevent an intruder from gaining access through the window). Once a WOCD is deactivated, the window may be opened completely; however, the WOCD remains deactivated until the window is subsequently closed at which time the WOCD must be automatically reset. Typically, the WOCD is a separate component from the window sash lock and tilt latch systems.

SUMMARY

In an aspect, the technology relates to a window lock system including: a sash lock including: a first housing configured to be mounted on a first window sash and defining a longitudinal axis; a lever rotatably coupled to the first housing and defining a rotation axis substantially orthogonal to the longitudinal axis; a cam at least partially disposed within the first housing and engaged with the lever so as to rotate around the rotation axis; a slide plate coupled to the cam and disposed within the first housing, wherein the slide plate is slidable along the longitudinal axis; and at least one actuator coupled to the slide plate and movable along the longitudinal axis; at least one tilt latch including: a second housing configured to be slidably mounted on the first window sash, wherein the second housing has a first end and an opposite second end that extend in a direction along the longitudinal axis; and a bolt slidingly coupled to the first end of the second housing; and a drive bar coupling the at least one actuator and the second end of the second housing, wherein the sash lock is movable between at least a locked position that engages at least a portion of the cam with a keeper on a second window sash, an unlocked position that disengages the cam from the keeper on the second window sash, and a tilt position by rotating the lever about the rotation axis and driving rotation of the cam and sliding of the slide plate, wherein when the sash lock is in the tilt position, the at least one actuator retracts relative to the first housing and via the drive bar retracts the first end of the second housing of the at least one tilt latch relative to a side surface of the first window sash.

In an example, when the sash lock is moved between the locked position and the unlocked position, the at least one actuator does not move relative to the first housing. In another example, when the sash lock is moved between the locked position and the unlocked position, the slide plate slides along the longitudinal axis. In yet another example, the sash lock further includes an elongate channel and a biasing member, the at least one actuator is disposed at least partially within the elongate channel and is biased relative to the elongate channel, and the sash lock is biased towards the unlocked position from the tilt position. In still another example, the sash lock further includes an elongate channel and a biasing member, the at least one actuator is disposed at least partially within the elongate channel and is biased relative to the elongate channel, and moving the sash lock from the unlocked position towards the tilt position at least partially overcomes the biasing member. In an example, the slide plate includes a first elongate slot and a second elongate slot, the first elongate slot being orthogonal to the second elongate slot, and a first post is slidably received at least partially within the first elongate slot and coupled to the cam, and a second post is slidably received at least partially within the second elongate slot and coupled to the at least one actuator. In another example, the at least one actuator includes a first actuator and a second actuator, an end of each of the first and second actuators include a rack coupled together by a rotatable cog.

In another aspect, the technology relates to a window lock system including: a sash lock configured to be mounted on a first window sash, the sash lock including: a first housing; a cam configured to selectively engage a keeper of a second window sash; at least one actuator; and a lever configured to drive movement of the cam and the at least one actuator relative to the first housing; at least one tilt latch configured to be slidably mounted on the first window sash, the at least one tilt latch including: a second housing having a first end and an opposite second end defining a longitudinal axis, wherein the first end is mounted proximate a side surface of the first window sash; a biasing mechanism disposed within the second housing; and a bolt at least partially disposed within the second housing proximate the first end and coupled to the biasing mechanism, wherein the bolt has a distal end configured to extend and retract along the longitudinal axis relative to the first end of the second housing; and a drive bar coupling the at least one actuator and the second end of the second housing.

In an example, movement of the actuator drives sliding movement of the second housing of the at least one tilt latch relative to the side surface of the first window sash via the drive bar. In another example, the bolt of the at least one tilt latch is movable between at least an extended position, a retracted bypass position, and a reset position, and the bolt is configured to be retained in either the extended position or the retracted bypass position. In yet another example, the at least one tilt latch further includes a cam disposed within the second housing, the bolt has a finger opposite of the distal end and the second housing has a support, and in the extended position the cam engages with the finger and in the retracted bypass position the cam engages with the support. In still another example, the cam is rotatable around the longitudinal axis. In an example, an elongated opening is defined in the second housing proximate the first end and the bolt has a projection at least partially slidingly disposed within the elongated opening, and the projection is accessible from outside of the second housing. In another example, a second keeper is configured to mount within a window jamb and selectively engage with the at least one tilt latch.

In another aspect, the technology relates to a tilt latch system for a window sash including: a tilt latch including: a housing configured to slidingly mount to the window sash, the housing including a first end and an opposite second end defining a longitudinal axis, wherein an elongated opening is defined within the housing proximate the first end; a biasing mechanism disposed within the housing; and a bolt at least partially disposed within the housing proximate the first end and coupled to the biasing mechanism, the bolt including a projection slidingly received at least partially within the elongated opening of the housing, wherein the bolt has a distal end configured to move between at least an extended position and a retracted bypass position along the longitudinal axis relative to the first end of the housing; and a keeper configured to mount within a window jamb of the window jamb, the keeper including an elongated slot configured to selectively receive at least a portion of the bolt and define at least partially an opening limit of the window sash when the tilt latch is engaged with the keeper.

In an example, the distal end of the bolt is engaged with the elongated slot in only the extended position. In another example, when the bolt is in the retracted bypass position, the first end of the housing is configured to slide within the window sash to disengage the bolt from the window jamb so that the window sash can tilt. In yet another example, a sash lock is coupled to the second end of the housing via a drive bar, the sash lock is configured to drive sliding movement of the first end of the housing. In still another example, the keeper includes a gate configured to selectively engage with the bolt and automatically move the bolt from the retracted bypass position towards the extended position when the tilt latch slides across the gate. In an example, the distal end of the bolt is also configured to move into a reset position, wherein in the reset position, the distal end is fully disposed within the housing.

BRIEF DESCRIPTION OF THE DRAWINGS

There are shown in the drawings, examples that are presently preferred, it being understood, however, that the technology is not limited to the precise arrangements and instrumentalities shown.

DETAILED DESCRIPTION

The window lock system described herein includes a sash lock and tilt latches. The sash lock is operably coupled to the tilt latches and enables the window lock system to function as a combination sash lock (e.g., via the sash lock), tilt latch (e.g., via the sash lock and tilt latch), and a window opening control device "WOCD" (e.g., via the tilt latch). The sash lock has a cam that selectively engages with a corresponding keeper to lock and unlock the window sash in relation to opening and closing (e.g., sliding movement) of the window sash. The tilt latch has a bolt that is configured to enable the window sash to latch and unlatch in relation to tilting of the window sash. The sash lock has one or more actuators that drives sliding movement of the tilt latches relative to the window sash to enable the tilt latch functionality. Additionally, the bolt of the tilt latch is configured to extend and retract from a tilt latch housing independently from the actuators to selectively engage with a corresponding WOCD keeper and control the opening sliding distance of the window sash. When closing the window sash after bypassing the WOCD keeper, the tilt latches are configured to automatically reset engagement with the WOCD keeper. As such, the window lock system described herein increases operating and locking performance for the window sash, and also increases resistance to impact loading on the window sash.

Figure 1:
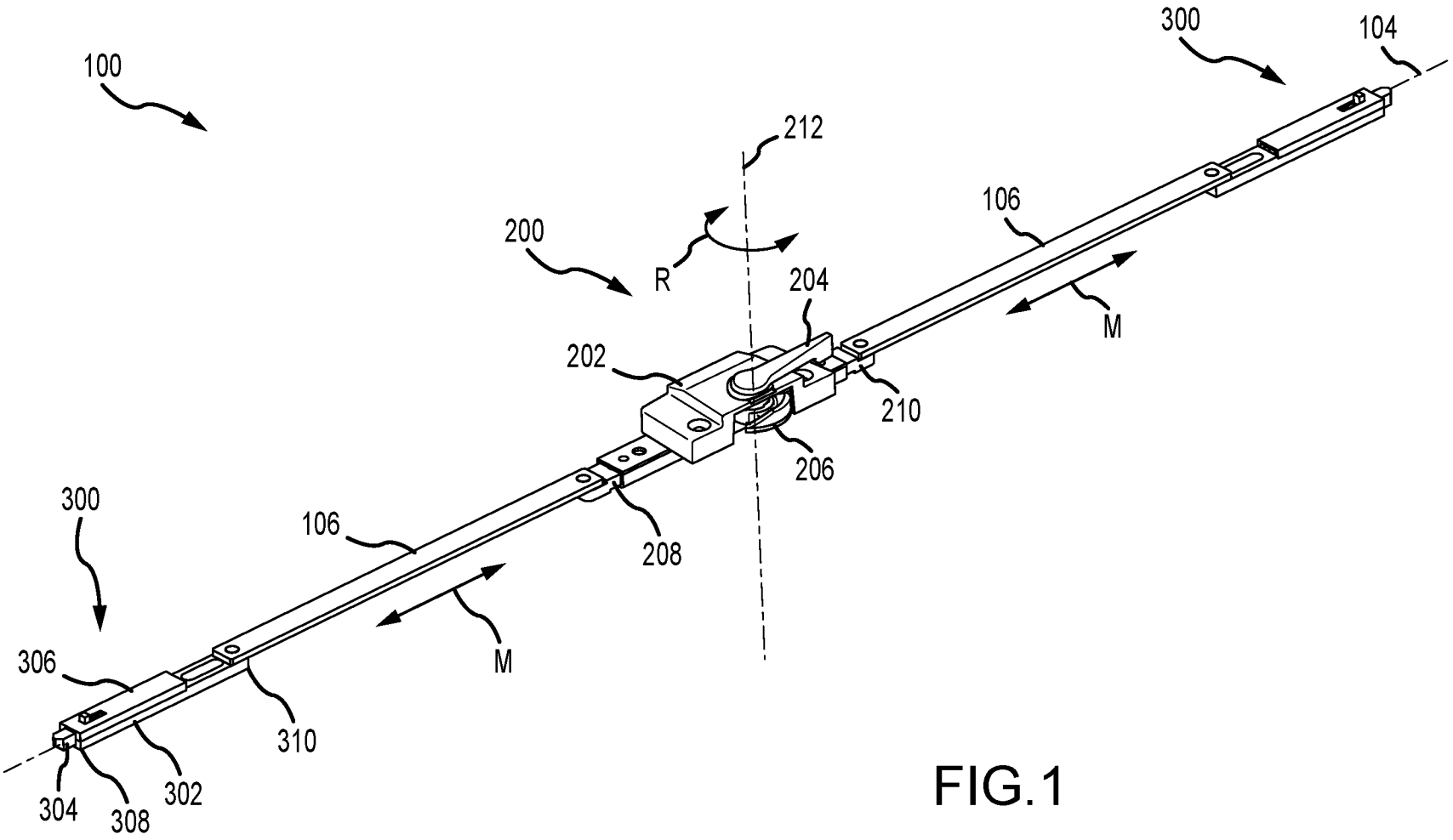
FIG. 1 is a perspective view of an exemplary window lock system for a tilt window.

FIG. 1 is a perspective view of an exemplary window lock system 100 for a tilt window 102 (shown in FIGS. 10-13). The window lock system 100 includes a sash lock 200 and a tilt latch 300. The sash lock 200 includes a housing 202, a lever 204, a cam 206, and a pair of actuators 208, 210. The housing 202 is configured to be mounted on a window sash with at least a portion of the actuators 208, 210 recessed at least partially within the top rail. The lever 204 is rotatably connected to the housing 202 and is disposed at least partially exterior of the housing 202. The cam 206 is at least partially disposed within the housing 202 and rotatable therein. The lever 204 is coupled to the cam 206 so upon rotation R of the lever 204 (e.g., via a window operator "user") about a rotation axis 212, the cam 206 rotates about the rotation axis 212 so as to lock and unlock the sash lock 200 relative to a window keeper (not shown) on an opposite window sash. As described herein, opening and closing the window sash includes sliding the window sash within the window jamb and locking and unlocking the window sash prevents or allows the opening and closing movement of the window sash. Rotation R of the lever 204 is also configured to linearly move M both actuators 208, 210 along a longitudinal axis 104 defined by the housing 202 and the window lock system 100 so as to retract the tilt latches 300 relative to a side surface the window sash. The longitudinal axis 104 is oriented substantially orthogonal to the rotation axis 212.

In the example, the window lock system 100 includes two tilt latches 300, one on each side of the sash lock 200. In other examples, the window lock system 100 may only include a single tilt latch 300 (e.g., the left or the right tilt latch) as required or desired. Each actuator 208, 210 is coupled to a drive bar 106 that is also coupled to the respective tilt latch 300. The drive bar 106 extends along the longitudinal axis 104. The tilt latch 300 includes a housing 302, a bolt 304, and a cover 306. The housing 302 is slidably mounted on the window sash and includes a first end 308 and a second end 310 that extend in a direction along the longitudinal axis 104. The bolt 304 is slidably coupled to the first end 308 of the housing 302 and is configured to selectively extend and retract along the longitudinal axis 104 independent from the movement M of the drive bars 106. In one example, the bolt 304 is a shoot bolt.

The tilt latch 300 is configured to selectively engage with the window jamb to latch or unlatch the window sash relative to the window jamb and enable the window sash to tilt. As described herein, tilting the window sash includes pivoting at least a portion of the window sash out of the window jamb and latching and unlatching the window sash prevents or allows the tilting movement of the window sash. Because the housing 302 is coupled to the drive bar 106, upon rotation R of the lever 204, the first end 308 of the housing 302 linearly moves M along the longitudinal axis 104 to latch or unlatch the bolt 304 from the window jamb. In an aspect, this movement M retracts the first end 308 of the housing 302 relative to the side surface of the window sash to unlatch the window sash from the jamb and allow the window sash to tilt.

The bolt 304 of the tilt latch 300 is also configured to selectively engage a WOCD keeper 400 (shown in FIGS. 10-13) that limits the opening distance of the window sash. However, to fully open the window sash, the WOCD keeper 400 must be bypassed. As such, the bolt 304 can be independently extended and retracted relative to the first end 308 of the housing 302 and relative the drive bar 106 movement M so that the WOCD keeper can be bypassed as required or desired.

The sash lock 200 is described further below in reference to FIGS. 2-5. The tilt latch 300 is described further below in reference to FIGS. 6-9. In operation, the bolt 304 of the tilt latch 300 is operable as a tilt latch component for the window sash and a WOCD component. The first end 308 of the housing 302 and the bolt 304 extend from the window sash to engage with the window jamb and latch the window sash to prevent tilting of the window sash. Additionally, the first end 308 can be retracted relative to the window sash to disengage the window jamb and unlatch the window sash to enable the window sash to tilt. In the example, this retracting movement is driven by the actuators 208, 210 of the sash lock 200 and the drive bars 106. However, the bolt 304 also needs to be able to bypass the WOCD keeper 400 as required or desired. Thus, the bolt 304 is independently movable relative to the first end 308 of the housing 302 to allow the window sash to bypass the WOCD keeper and enable the window sash to fully open as required or desired. As such, the window lock system 100 described herein functions as a sash lock (e.g., via the cam 206), a tilt latch (e.g., via the first end 308 of the housing 302 and actuators 208, 210), and a WOCD device (e.g., via the bolt 304). The window lock system 100 increases operating and locking performance for the window sash, and also increases resistance to impact loading on the window sash as a result of the WOCD keeper being secured to the back wall of the window jamb into the window rough opening.

Figure 2:
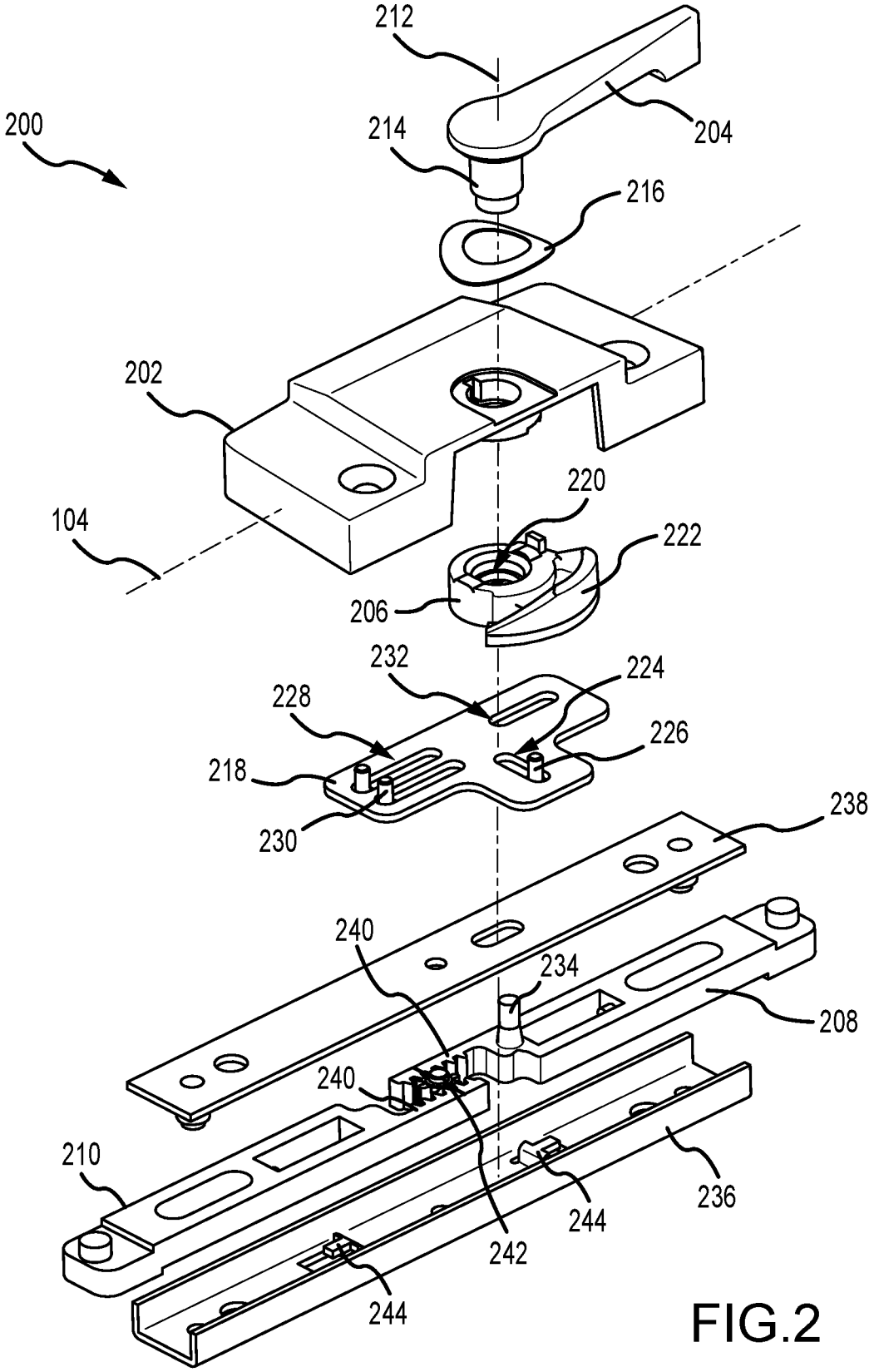
FIG. 2 is an exploded perspective view of an exemplary sash lock of the window lock system shown in FIG. 1.

FIG. 2 is an exploded perspective view of the sash lock 200 of the window lock system 100 (shown in FIG. 1). The sash lock 200 includes the lever 204 that is rotatable about the rotation axis 212. The lever 204 includes a post 214 that extends into the housing 202 and couples to the cam 206 so as to drive rotation thereof. In some examples, a spring washer 216 may be disposed between the exterior of the housing 202 and the lever 204. The housing 202 is configured to mount on top of a window sash and at least partially houses the cam 206 and a slide plate 218. In the example, the cam 206 is generally disc-shaped and includes an opening 220 that receives the post 214 of the lever 204. The cam 206 also includes a cam surface 222 that is configured to selectively engage with a keeper on another window sash to lock the window. Upon rotation of the cam 206, the cam surface 222 can extend from the housing 202 to engage with the keeper and lock the window sash with respect to opening and closing, and retract at least partially back into the housing 202 to disengage the keeper and unlock the window sash with respect to opening and closing.

The slide plate 218 is coupled to the cam 206 and is disposed within the housing 202. The housing 202 extends along the longitudinal axis 104 and the slide plate 218 is configured to slide within the housing 202 and along a direction that is substantially parallel with the longitudinal axis 104. In the example, the slide plate 218 is substantially T-shaped with a leg that is substantially orthogonal to the longitudinal axis 104 and a crossbar that is substantially parallel to the longitudinal axis 104. The leg of the slide plate 218 has a first elongate opening 224 that extends in a direction that is substantially orthogonal to the longitudinal axis 104. The opening 224 receives a portion of a cam post 226 such that the slide plate 218 is coupled to the cam 206 and the cam post 226 can slide within the opening 224. The cam post 226 couples to the underside of the cam 206 so that the post 226 slides within the opening 224 upon rotation of the cam 206 via the lever 204. In one example, the cam post 226 can be a bolt that couples to the underside of the cam 206 and can rotate relative thereto to facilitate the post 226 linearly sliding within the opening 224.

The crossbar of the slide plate 218 has a pair of second elongate openings 228 that extend in a direction that is substantially parallel to the longitudinal axis 104. Each opening 228 receives a portion of a housing post 230 such that the housing post 230 can slide within the opening 228. The housing post 230 couples to the underside of the housing 202 so that the slide plate 218 is coupled to the housing 202 while linear movement is still enabled. By using a pair of openings 228 and posts 230, rotation of the slide plate 218 within the housing 202 is restricted or prevented. In one example, the housing posts 230 can be a bolt. Additionally, the crossbar of the slide plate 218 has a third elongate opening 232 that extends in a direction that is substantially parallel to the longitudinal axis 104. In the example, the third opening 232 is spaced apart the from the second opening 228 and the first opening 224 is at least partially therebetween. In an aspect, the third opening 232 may be substantially aligned with one of the second openings 228 along the longitudinal axis 104. The third opening 232 receives a portion of an actuator post 234 such that the actuator post 234 can slide within the opening 232. The actuator post 234 extends from one of the actuators 208, 210 and into the slide plate 218 so that the slide plate 218 is coupled to one of the actuators 208, 210. Movement of the slide plate 218 along the longitudinal axis 104 via the lever 204, drives movement of the actuators 208, 210 via the engagement between the actuator post 234 and the opening 232.

The actuators 208, 210 are movable relative to the housing 202 and along the longitudinal axis 104. In the example, the actuators 208, 210 are disposed below the housing 202 and at least partially housed in an elongate channel 236 that has a cover 238. The actuators 208, 210 and channel 236 are typically recessed at least partially within the window sash, while the housing 202 is mounted on top. Each actuator 208, 210 has a rack 240 on one end that is engaged with a rotatable cog 242. In the example, the rotatable cog 242 has an axis of rotation that is substantially parallel to the rotation axis 212 of the lever 204 and the cam 206. As such, linear movement of the actuator 208 via the actuator post 234 from the slide plate 218 drives corresponding linear movement of the other actuator 210 along the longitudinal axis 104. Opposite of the rack 240, each actuator 208, 210 is configured to couple to the drive bar 106 (shown in FIG. 1). A biasing member 246 (shown in FIGS. 3-5) is coupled between each actuator 208, 210 and the channel 236 (e.g., at connectors 244) so as to bias the actuators 208, 210 into an extended position relative to the channel 236 and the housing 202. In one example, the biasing member 246 may be a compression spring, so as to bias the actuators 208, 210 into an extended position relative to the housing 202 and the channel 236. The biasing member 246 may also provide assistance in moving the cam 206 to an unlocked position as described herein.

Figure 3:
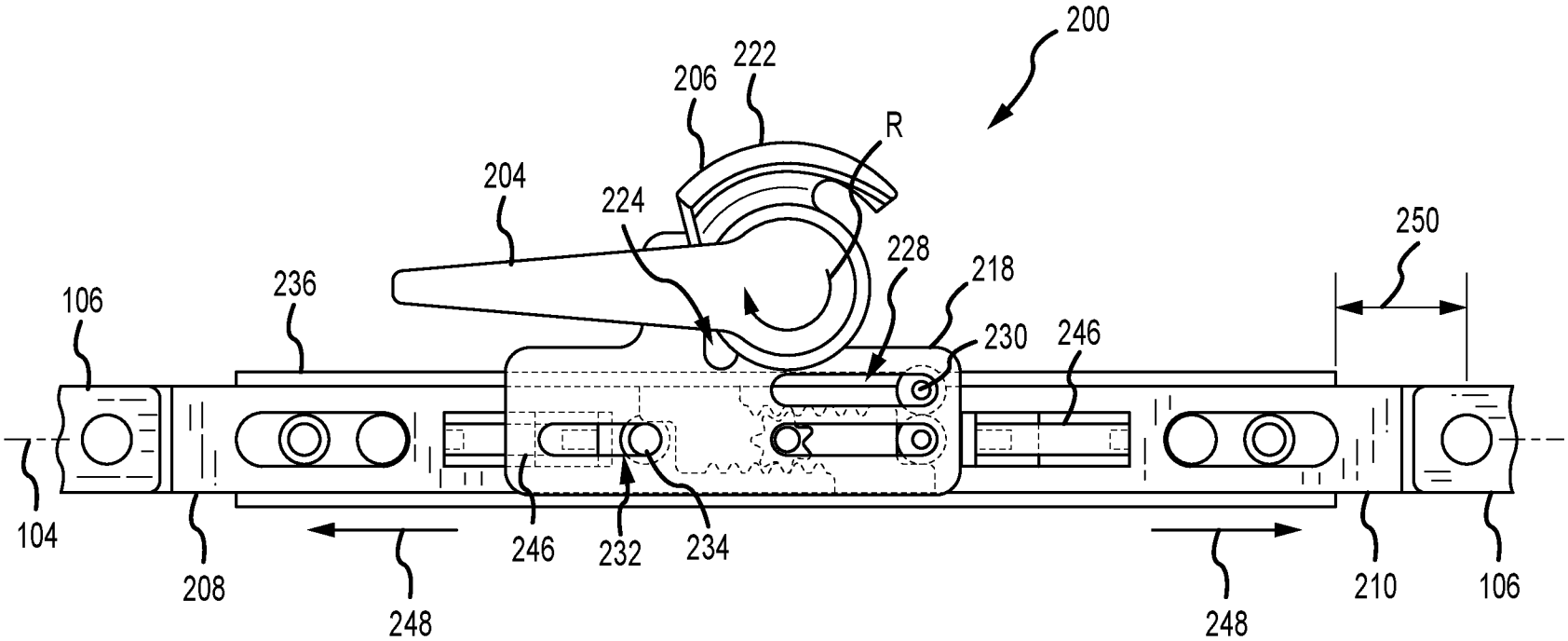
FIG. 3 is a partial top view of the sash lock in a locked position.

FIG. 3 is a partial top view of the sash lock 200 in a locked position. The slide plate 218 is illustrated as transparent to show the position of the components below. In the locked position, the lever 204 is rotated R to the left and in a position that is substantially parallel to the longitudinal axis 104. In this position of the lever 204, the cam surface 222 at least partially extends out of the housing 202 (shown in FIGS. 1 and 2) so as to engage with a corresponding window keeper (not shown). As such, the sash lock 200 is considered locked and the window sash cannot be opened by sliding the window sash within the jamb. This position of the lever 204 also has the slide plate 218 positioned in its left-most position. When the lever 204 is in the left-most position, the cam post 226 (shown in FIG. 2 and would be directly underneath the lever 204) is at the top end of the first elongated opening 224 and the opening 224 is on the left side of the rotation axis so that the slide plate 218 is also in its left-most position.

It should be appreciated that while left and right directions are described, the sash lock 200 could also be reversely oriented (e.g., the locked position occurring on the right-most position) as required or desired.

Additionally, the left-most position of the slide plate 218 in the locked position as illustrated in FIG. 3 results in the housing posts 230 at the right end of the second elongated openings 228 and the actuator post 234 at the right end of the third elongated opening 232. This position of the actuator post 234 (e.g., at the right end of the opening 232), allows both actuators 208, 210 to at least partially extend away from the channel 236 in an outward extended direction 248. In the example, the ends of the actuators 208, 210 that couple to the drive bars 106 extend out from the ends of the channel 236 a first distance 250. The first distance 250 corresponds to the extension 248 configuration of the sash lock 200. Since the actuators 208, 210 are coupled to the drive bars 106, the drive bars 106 are also extended 248 away from the channel 236 along the longitudinal axis 104. This extended position 248 of the actuators 208, 210 and the drive bars 106 cause the tilt latches 300 (shown in FIG. 1) to protrude from the side surfaces of the window sash and to prevent the window sash from tilting out of the jamb.

The biasing member 246 is coupled between each actuator 208, 210 and the channel 236 so as to bias the actuators in the extended direction 248. For example, the biasing member 246 coupled between the actuator 208 and the channel 236 enables the actuator 208 to be extended 248 while the actuator post 234 is towards the right end of the third elongated opening 232. This configuration drives the drive bars 106 and the tilt latches 300 in an outward direction and latches the window sash with the drive bars 106 in compression. The locked position also includes the slide plate 218 in its left-most position with the opening 224 disposed on the left side of the rotation axis.

Figure 4:
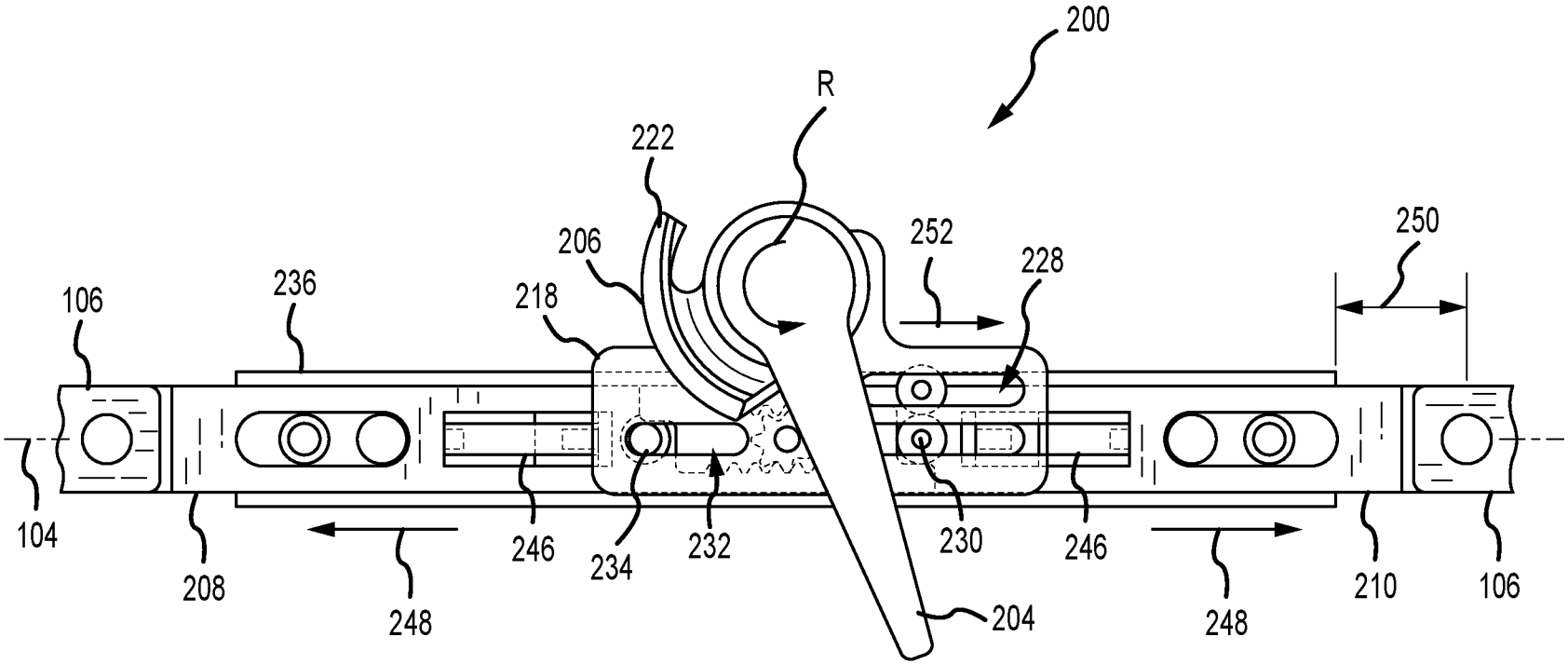
FIG. 4 is a partial top view of the sash lock in an unlocked position.

FIG. 4 is a partial top view of the sash lock 200 in an unlocked position. The slide plate 218 is illustrated as transparent to show the position of the components below. In the unlocked position, the lever 204 is rotated R to the right. In one aspect, this rotation R is between about 90° and 180° from the locked position shown in FIG. 3. In this position of the lever 204, the cam surface 222 is retracted at least partially into the housing 202 (shown in FIGS. 1 and 2) so as to disengage with the corresponding window keeper (not shown). As such, the sash lock 200 is considered unlocked and the window sash can be opened (e.g., at least partially slide within the window jamb). This position of the lever 204 also moves 252 the slide plate 218 towards the right along the longitudinal axis 104. When the lever 204 is moved to the unlocked position, the cam post 226 (shown in FIG. 2 and would be directly underneath the lever 204) is moved to the bottom end of the first elongated opening 224 (shown in FIG. 2) and towards the right in an intermediate position. This movement of the post 226 moves 252 the slide plate 218 into the intermediate position as illustrated in FIG. 4 so that the opening 224 slides towards the right side of the rotation axis.

Additionally, the movement 252 of the slide plate 218 in the intermediate position results in the housing posts 230 moving towards the left end of the second elongated openings 228 and the actuator post 234 towards the left end of the third elongated opening 232. This position of the actuator post 234 (e.g., at the left end of the opening 232), however, does not move (e.g., retract) the actuators 208, 210 and the actuators still extend at least partially away from the channel 236 in an outward extended direction 248. As such, the first distance 250 of the ends of the actuators 208, 210 relative to the end of the channel 236 remains approximately the same as in the locked position (shown in FIG. 3). The actuators 208, 210 do not move relative to the channel 236 when the sash lock 200 is moved between the locked position and the unlocked position. However, the slide plate 218 still slides 252 along the longitudinal axis 104 when the sash lock 200 is moved between the locked position and the unlocked position.

The elongated length of the opening 232 enables this movement of the slide plate 218 without inducing movement of the actuators 208, 210. As such, the first end 308 of the housing 302 of the tilt latches 300 (shown in FIG. 1) still protrudes from the side surface of the window sash and engaged with the window jamb so that only sliding movement of the window sash is enabled and the window sash is still latched to prevent tilting. This position of the tilt latch 300 also enables for the WOCD keeper 400 (shown in FIGS. 10-13) to be selectively engaged via the bolt 304 (shown in FIG. 1). The biasing member 246 assists in retaining the extended position 248 of the actuators 208, 210 and automatically returns the actuators 208, 210 towards the extended position 248 when moved out of position. The unlocked position includes the slide plate 218 moving towards the right in an intermediate position while the actuators 208, 210 remain in the extended direction 248.

Figure 5:
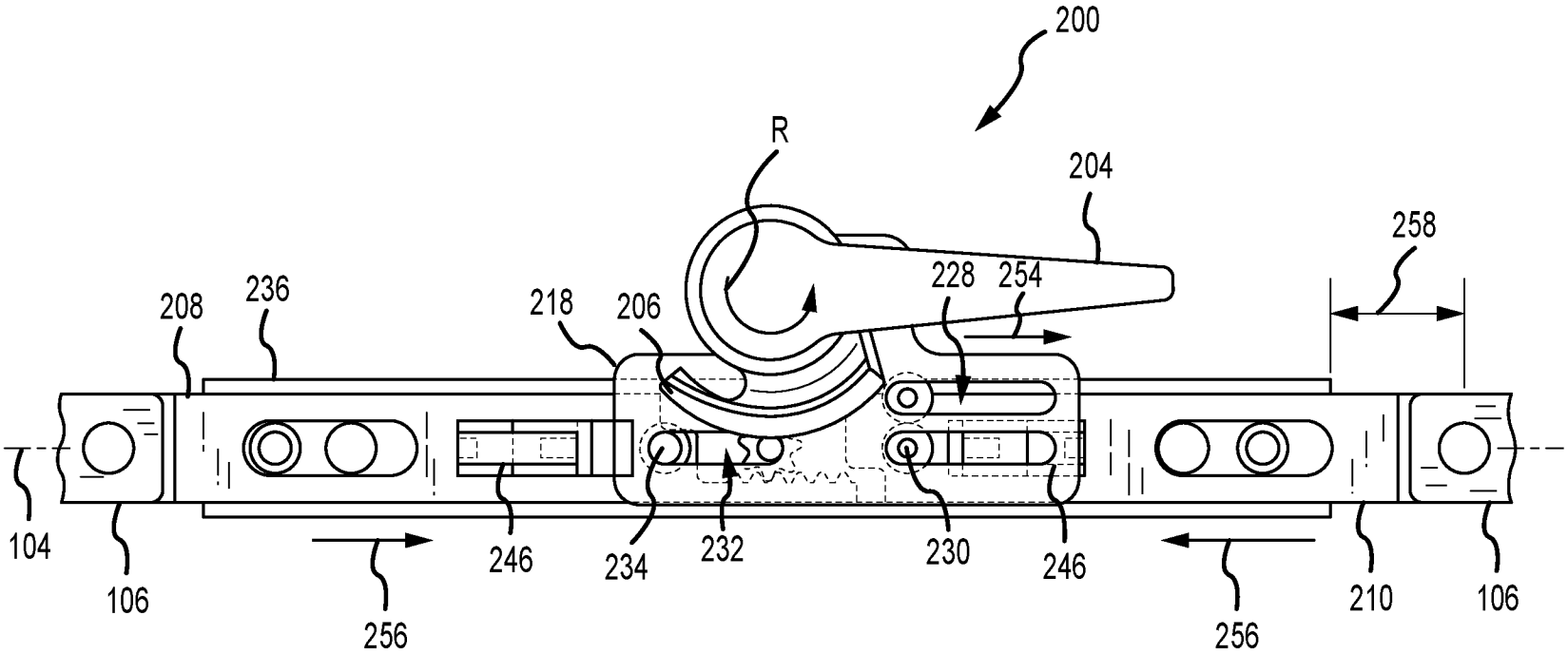
FIG. 5 is a partial top view of the sash lock in a tilt position.

FIG. 5 is a partial top view of the sash lock 200 in a tilt position. The slide plate 218 is illustrated as transparent to show the position of the components below. In the tilt position, the lever 204 is rotated R to its right-most position. In one aspect, this rotation R is about 180° from the locked position shown in FIG. 3. In this position of the lever 204, the cam 206 remains disengaged with the corresponding window keeper (not shown), and as such, the sash lock 200 is considered unlocked and the window sash can be opened. This position of the lever 204 also moves 254 the slide plate 218 towards its right-most position along the longitudinal axis 104. When the lever 204 is moved to the tilt position, the cam post 226 (shown in FIG. 2 and would be directly underneath the lever 204) is moved to the top end of the first elongated opening 224 (shown in FIG. 2) and further towards the right. This movement of the post 226 moves 254 the slide plate 218 so that the opening 224 slides towards the right side of the rotation axis.

Additionally, the movement 254 of the slide plate 218 to its right-most position results in the housing posts 230 moving to the left end of the second elongated openings 228 and the actuator post 234 at the left end of the third elongated opening 232. This position of the actuator post 234 (e.g., at the left end of the opening 232) and the movement 254 of the slide plate 218 causes the actuators 208, 210 to at least partially retract into the channel 236 in an inward retraction direction 256. Since the actuators 208, 210 are coupled to the drive bars 106, the drive bars 106 are also retracted towards the channel 236 along the longitudinal axis 104. This retraction of the actuators 208, 210 at least partially overcomes the biasing force of the biasing members 246. For example, the biasing members 246 are compressed in the tilt position. Thus, upon release of the lever 204 when in the tilt position, the sash lock 200 automatically return towards the unlocked position (shown in FIG. 4) and the extended configuration of the actuators 208, 210. The sash lock 200 is biased toward the unlocked position from the tilt position.

In the example, the ends of the actuators 208, 210 that couple to the drive bars 106 retract inwards from the ends of the channel 236 a second distance 258. The second distance 258 corresponds to the retraction configuration of the sash lock 200. This retraction 256 of the actuators 208, 210 retract the first end 308 of the tilt latches 300 (shown in FIG. 1) from the side surfaces of the window sash. The retraction of the tilt latches 300 via the sash lock 200 does not necessarily result in the window sash being enabled to tilt; rather, the bolt 304 (shown in FIG. 1) also needs to be moved towards its retracted bypass position as described further below in FIG. 8 to unlatch the window sash and enable the window sash to tilt. In an aspect, the difference between the first distance 250 (shown in FIGS. 3 and 4) and the second distance 258 corresponds to the difference between an extension length of the bolt 304 relative to the housing 302 in the extend position (shown in FIG. 7) and the retracted bypass position (shown in FIG. 8). The tilt position includes the slide plate 218 in its right-most position with the opening 224 disposed on the right side of the rotation axis and the actuators 208, 210 in the retracted position 256.

Figure 6:
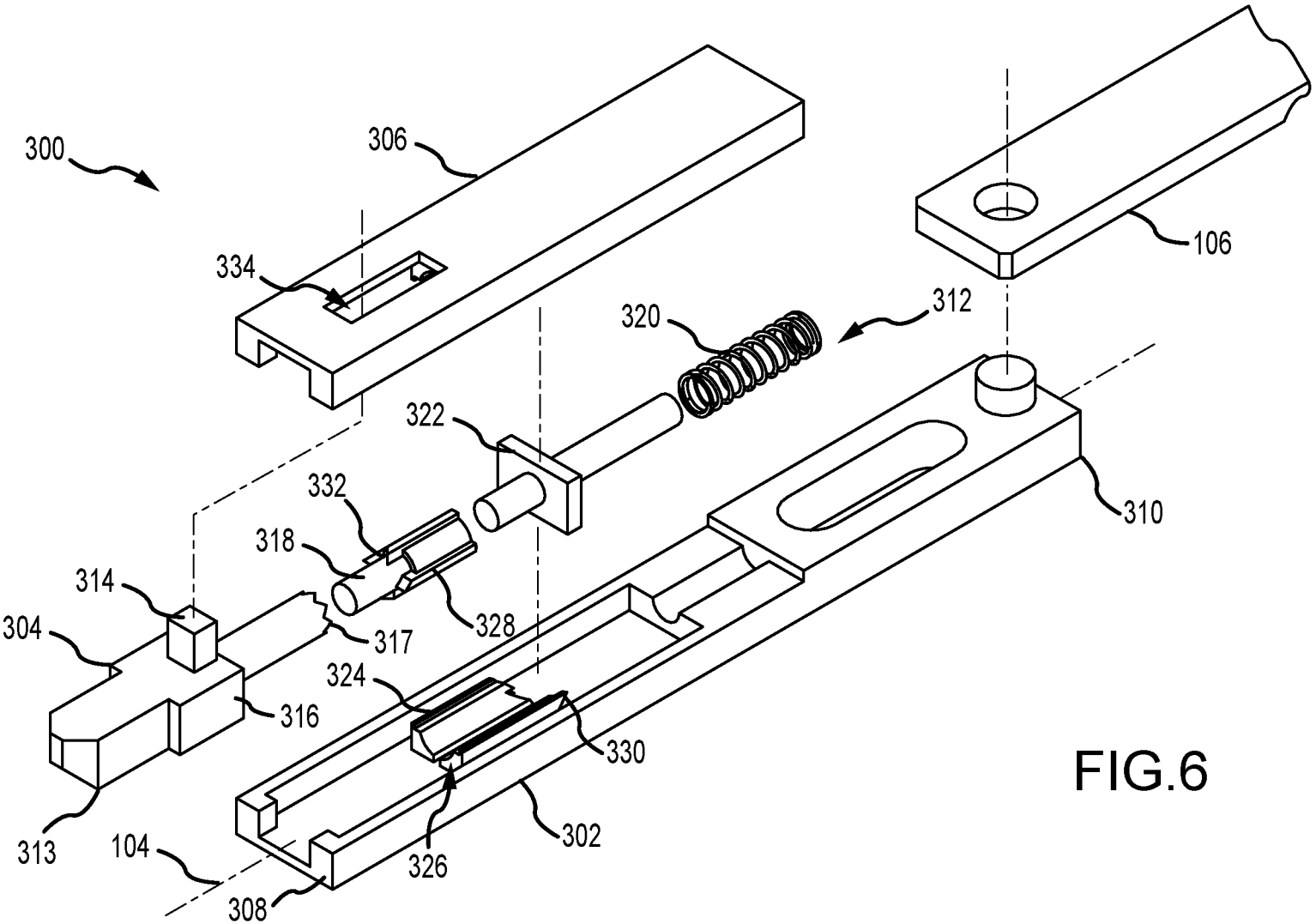
FIG. 6 is an exploded perspective view of an exemplary tilt latch of the window lock system shown in FIG. 1.

FIG. 6 is an exploded perspective view of the tilt latch 300 of the window lock system 100 (shown in FIG. 1). The tilt latch 300 is configured to be slidably mounted on the window sash. The tilt latch 300 includes the housing 302 with the first end 308 mounted adjacent to a side surface of the window sash and the second end 310 that is coupled to the drive bar 106 so that the tilt latch 300 can be retracted relative to the side surface of the window sash by the sash lock 200 (shown in FIGS. 2-5) and as described above. The bolt 304 is at least partially disposed within the housing 302 proximate the first end 308. A biasing mechanism 312 is disposed within the housing 302 and coupled to the bolt 304. The housing 302 supports the bolt 304 and the biasing mechanism 312 that is configured to extend and retract a distal end 313 of the bolt 304 relative to the first end 308 of the housing 302 along the longitudinal axis 104 and separately from the movement of the drive bar 106.

In the example, the biasing mechanism 312 enables the bolt 304 to function like a click pen so that the bolt 304 can manually be retracted at least partially into the housing 302 via a projection 314 that extends from the cover 306 and then retain its retracted position until the bolt 304 is reset by being further depressed and released back into an extended position. This further depression of the bolt 304 can be automatic via one or more components positioned in the window jamb (e.g., the WOCD keeper 400, 500 shown in FIGS. 10-15) or manual as required or desired. In the example, the bolt 304 functions as a push button and has a finger 316 opposite the distal end 313 and with a cam surface 317 on its axial end. The bolt 304 can be slid in and out of the first end 308 of the housing 302 and along the longitudinal axis 104 and be held in an extended or retracted bypass position as described below.

The biasing mechanism 312 includes a cam 318, a compression spring 320, and a guide 322. The cam 318 is rotatable around the longitudinal axis 104 and relative to the bolt 304, the guide 322, and the housing 302. The cam 318 includes a first end that can be at least partially inserted into the finger 316 and a second end supported by the guide 322. The cam 318 is also at least partially supported on one or more supports 324 within the housing 302. The support 324 enables the cam 318 to slide along the longitudinal axis 104 and relative to the housing 302 and to rotate around the longitudinal axis 104. In the example, the support 324 includes one or more longitudinal guide tracks 326 that circumferentially spaced channels 328 of the cam 318 can selectively ride within. Additionally, the axial end of the support 324 has a cam surface 330. The cover 306 may also have a support 324 as required or desired. The cam 318 has an axial cam surface 332 that is configured to selectively engage with the cam surfaces 317, 330 of the finger 316 or the support 324. The cam 206 is biased via the compression spring 320 acting against the guide 322 and towards the first end 308 of the housing 302. In operation, the cam 318 selectively engages with either the cam surface 317 on the finger 316 or the cam surface 330 on the support 324 so as to retain the position of the bolt 304 in either the extended or retracted bypass position. The cam 318 then rotates upon every depression reset of the bolt 304 via the cam surfaces so as to cycle between the extended or retracted bypass positions of the bolt 304 while holding the bolt 304 in the extended or retracted bypass position. In an aspect, the cam 318 engages with the finger 316 in the extended position and the cam 318 engages with the support 324 in the retracted bypass position. The extended and retracted bypass positions of the bolt 304 are described further below in reference to FIGS. 7-9.

The cover 306 of the housing 302 enables access to the components therein and has an elongated opening 334 proximate the first end 308 that is sized and shaped to receive at least a portion of the projection 314 of the bolt 304 and slide therein. This allows for the projection 314 of the bolt 304 to be accessible from outside of the cover 306 and for the window operator to manually depress the bolt 304 and move its position.

Figure 7:
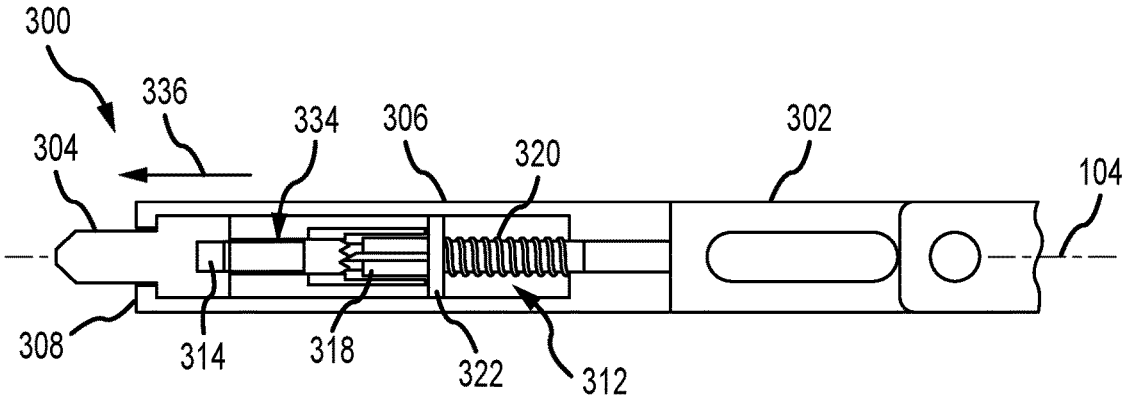
FIG. 7 is a top view of the tilt latch in an extended position.

FIG. 7 is a top view of the tilt latch 300 in an extended position. The cover 306 is illustrated as transparent to show the position of the components below. In the extended position, the bolt 304 is fully extended 336 from the first end 308 of the housing 302 by the biasing mechanism 312 and along the longitudinal axis 104. The projection 314 of the bolt 304 is positioned at the outer end of the elongate opening 334 defined within the cover 306. The spring 320 urges the guide 322 towards the first end 308 of the housing 302 so that the cam 318 moves towards the first end and the cam 318 is engaged with the finger of the bolt 304.

In the extended position, the bolt 304 extends 336 from the first end 308 of the housing 302. The bolt 304 is configured to engage with a keeper (not shown) that is disposed within the window jamb. By using a keeper, the strength of the tilt latch 300 increases compared to using only the jamb channel so that the window sash increases its resistance to impact loading. In an aspect, the bolt 304 is configured to engage with the WOCD keeper 400 (shown in FIGS. 10-13) so as to selectively restrict sliding movement of the window sash. The keeper 400 has an elongated slot that allows the bolt 304 to slide therein and limit the opening distance of the window sash, when the window sash is unlocked as described above in reference to FIG. 4.

Figure 8:
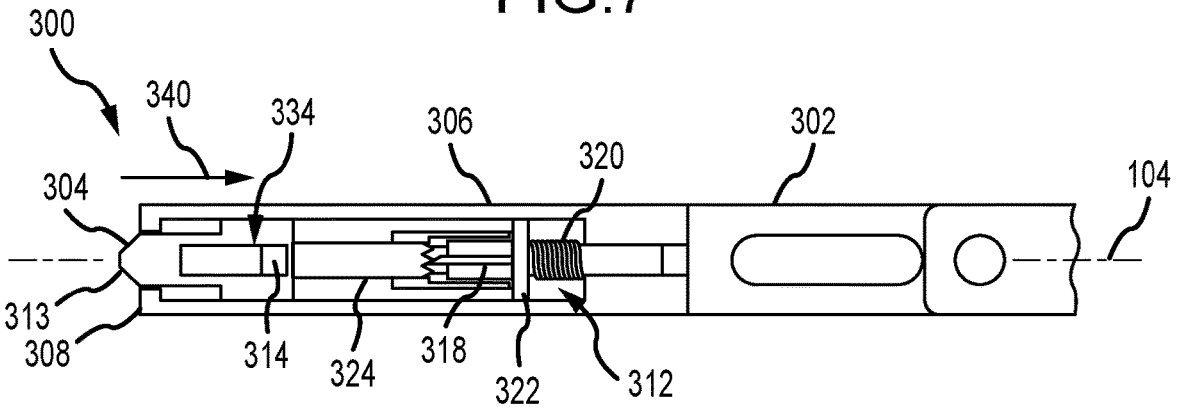
FIG. 8 is a top view of the tilt latch in a retracted bypass position.

FIG. 8 is a top view of the tilt latch 300 in a retracted bypass position. The cover 306 is illustrated as transparent to show the position of the components below. In the retracted bypass position, the bolt 304 is retracted 340 at least partially into the first end 308 of the housing 302 by the biasing mechanism 312 and along the longitudinal axis 104 when compared to the extended position illustrated in FIG. 7. In an aspect, this partial retraction 340 of the bolt 304 still has a portion of the distal end 313 extending from the first end 308 of the housing 302. However, the distal end 313 does not extend as far out from the first end 308 of the housing 302 when compared to the extended position (shown in FIG. 7). The projection 314 of the bolt 304 is positioned between the outer end and the inner end of the elongate opening 334 defined within the cover 306, but closer to the inner end. The spring 320 is urging the guide 322 towards the first end 308 of the housing 302 but the cam 318 engaged with the support 324 so that the bolt 304 does not fully extend from the housing 302 as in the extended position (shown in FIG. 7).

In operation, moving the bolt 304 towards the retracted bypass position is typically performed manually by the window operator. Because the first end 308 of the housing 302 is at least partially engaged with the window jamb unless retracted by the sash lock 200 in the tilt position (shown in FIG. 5), retracting the bolt 304 alone does not allow for the window sash to be unlatched and allowed to tilt. However, by retracting the bolt 304 the distal end 313 of the bolt 304 is positioned closer to the first end 308 so that moving the sash lock 200 into the tilt position allows the tilt latch 300 to unlatch the window sash and enable the tilting movement. In some examples, the extended position of the tilt latch 300 in the retracted bypass position does not enable the unlatching of the window sash. As such, in one example, the extension length of the bolt 304 between the extended position and the retracted bypass position is greater than the movement of the actuators 208, 210 of the sash lock 200 relative to the channel 236 as described in FIGS. 3-5.

In the retracted bypass position, the bolt 304 is partially extended from first end 308 of the housing 302, but this position is configured to not engage with the WOCD keeper 400 (shown in FIGS. 10-13) so that the WOCD keeper 400 can be selectively bypassed and allow the window sash to open. To overcome the WOCD, two separate steps are required by the operator, moving the bolt 304 from each of the right and left tilt latches 300 into the retracted bypass position. The window sash can then slide past the WOCD keeper 400 and be fully opened. As such, the retracted bypass position typically occurs after bypassing the WOCD keeper 400 and the tilt latch 300 is positioned above the keeper 400 and not engaged therewith. As such, the tilt latch 300 can still latch the window sash while enabling sliding movement when in the retracted bypass position until the sash lock 200 is moved towards the tilt position. In an aspect, when the sash lock 200 is moved to its tilt position, the distal end 313 of the bolt 304 is retracted at least partially within the side of the window sash to allow the window sash to be tilted.

Figure 9:
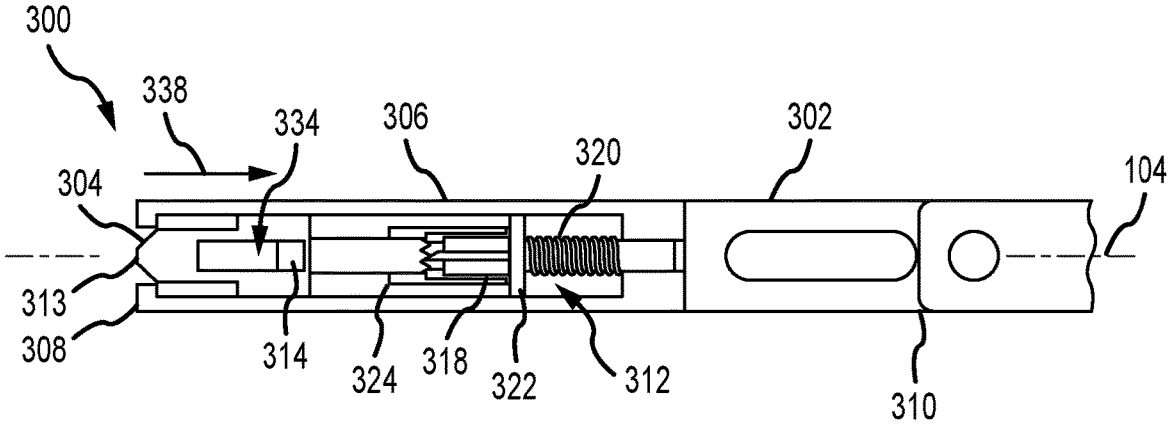
FIG. 9 is a top view of the tilt latch in a reset position.

FIG. 9 is a top view of the tilt latch 300 in a reset position. The cover 306 is illustrated as transparent to show the position of the components below. In the reset position, the bolt 304 is fully retracted 338 into the first end 308 of the housing 302 by overcoming the biasing mechanism 312 along the longitudinal axis 104 from the retracted bypass position illustrated in FIG. 8. The projection 314 of the bolt 304 is positioned at the inner end of the elongate opening 334 defined within the cover 306. This actuation of the bolt 304 is typically performed automatically by the tilt latch 300 and keeper 400 (shown in FIGS. 10-13) engaging during closing of the window sash. Alternatively, this actuation of the bolt 304 can performed manually by the operator of the window (e.g., the operator pushing the projection 314 inward) as required or desired. When the bolt 304 is depressed, the spring 320 is compressed and the guide 322 moves towards the second end 310 of the housing 302. Additionally, the cam 318 moves towards the second end 310 and rotates so as to switch engagement between the bolt 304 and the support 324. In the reset position, the distal end 313 of the bolt 304 is completely received within the housing 302.

In the reset position, the bolt 304 is retracted 338 into the first end 308 of the housing 302 so that the bolt 304 can reset back towards the extended position (shown in FIG. 7) from the retracted bypass position (shown in FIG. 8). As such, upon release of the bolt 304 from the reset position, the bolt 304 moves towards the extended position. This allows for the tilt latch 300 to reset its engagement with the WOCD keeper 400 automatically.

Referring now to FIGS. 7-9, it should be appreciated that the movement between the extended position, the retracted bypass position, and the reset position is in a cycle and the biasing mechanism allows for the extended position and the retracted bypass position to be held until being reset from the retracted bypass position. This configuration of the tilt latch 300 and the bolt 304 allows for selective engagement with a WOCD keeper 400 that can be bypassed and automatically reengaged as described below. Additionally, the tilt latch 300 is enabled to latch and unlatch the window sash for tilting.

Figure 10:
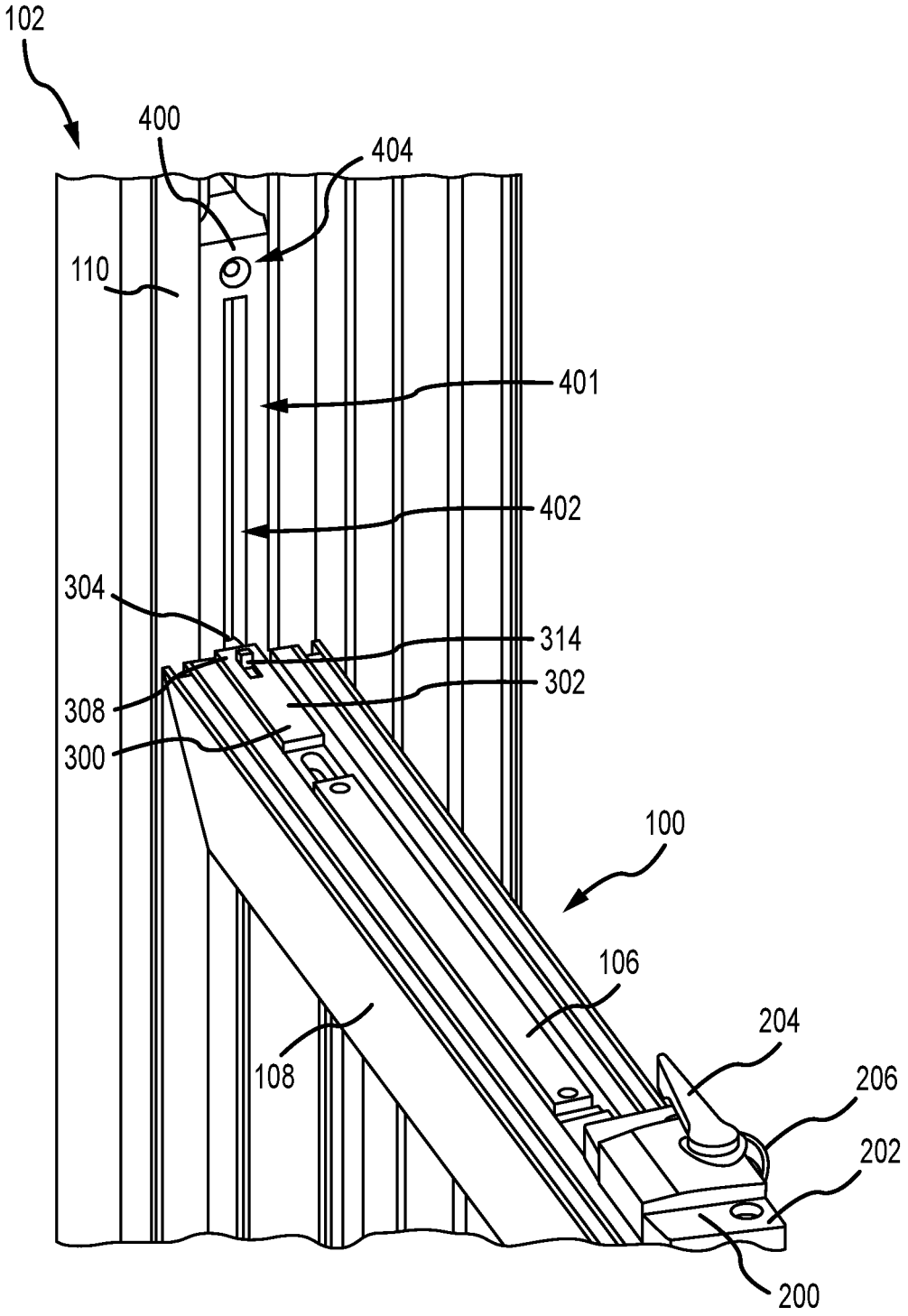
FIG. 10 is a perspective view of the window lock system with the sash lock in the locked position and the tilt latch in the extended position.

FIG. 10 is a perspective view of the window lock system 100 with the sash lock 200 in the locked position (e.g., FIG. 2) and the tilt latch 300 in the extended position (e.g., FIG. 7). The tilt window 102 includes a first sash 108 and a second sash (not shown). In the example, at least the first sash 108 is configured to selectively slide vertically within a window jamb 110 and also tilt out of the plane of the window jamb 110. The window lock system 100 is configured to control both the sliding and tilting movement of the window sash 108. The window lock system 100 is at least partially mounted within a top rail of the window sash 108, for example, within a recessed channel in a top surface of the top rail. The sash lock 200 is typically mounted near the center of the top rail, while the tilt latches 300 are disposed along the sides, and the two components are connected by the drive bar 106. In the example, the housing 202 of the sash lock 200 is mounted above the top rail while the actuators and drive bars 106 are at least partially recessed within the top rail. In an aspect, a cover (not shown) may be used to hide portions of the window lock system 100 within the top rail as required or desired. The housing 302 of the tilt latches 300 are disposed at the side surfaces of the window sash 108 and with the projection 314 of the bolt 304 accessible to the window operator at the top rail. The housing 302 is mounted at least partially within the top rail and is configured to slide relative to the top rail of the window sash. In the locked position, the first end 308 of the housing 302 projects at least partially from the side surface of the window sash 108 and so that at least a portion of the first end 308 is disposed within the window jamb 110.

When the sash lock 200 is in the locked position, the lever 204 is turned so that the cam 206 at least partially extends from the housing 202 and engages with a corresponding window keeper on the second sash (not shown). This engagement between the cam 206 and the window keeper prevents vertical movement of the window sash 108 and so as to lock the window sash 108 in a closed position. Additionally, when the sash lock 200 is in the locked position, the drive bar 106 is in an extended position so that the first end 308 of the tilt latch 300 projects from the side of the window sash 108. As such, the first end 308 of the housing 302 is received within the window jamb 110. When the tilt latch 300 is in the extended position, the distal end of the bolt 304 projects from the first end 308 of the housing 302 and is also received with the window jamb 110. Thus, the tilt latch 300 is preventing the window sash 108 from tilting.

Also illustrated in FIG. 10 is the WOCD keeper 400 that is configured to selectively engage with the window lock system 100 and define the integrated window opening control device and limit the opening distance of the window sash 108 when engaged. In the example, the WOCD keeper 400 is configured to mount within the window jamb 110. A front surface 401 of the WOCD keeper 400 is recessed within the window jamb 110 so that it is inwardly offset and allows the first end 308 of the tilt latch 300 to slide relative to the keeper 400 while still being received within the window jamb. The WOCD keeper 400 has an elongated slot 402 that is sized and shaped to at least partially receive the bolt 304 of the tilt latch 300. The WOCD keeper 400 can be mounted proximate the top rail of the window sash 108 when the window sash is closed so that a bottom end of the elongated slot 402 corresponds to the window sash in a closed configuration and a top end of the elongated slot 402 at least partially defines an opening limit distance of the window sash 108 when unlocked via the sash lock 200. The keeper 400 can have top and bottom apertures 404 so that the keeper 400 can be fastened within the window jamb 110. In one example, the slot 402 may be about 4 inches long so as to define the opening limit of the window sash 108 when the window opening control device is engaged.

The tilt latch 300 is illustrated in FIG. 10 with the bolt 304 in the extended position and the first end 308 positioned adjacent to the front surface 401 because the sash lock 200 is extending the drive bars 106. As such, when the bolt 304 is engaged within the slot 402, the strength of the engagement between the top rail of the window sash 108 and the window jamb 110 increases so as to increase the impact resistance strength of the tilt window 102. It should be appreciated that while the WOCD keeper 400 is shown, the window lock system 100 can be used with other types of keepers as well, some keepers which may not provide window opening control capabilities. For example, a keeper may have an elongated slot that extends more than 4 inches, or even the majority of the opening distance of the window sash 108. While this keeper example does not provide opening control, the keeper still increases the impact resistance strength of the tilt window when the slot is in receipt of the bolt 304 because the keeper is stronger than the window jamb itself.

Figure 11:
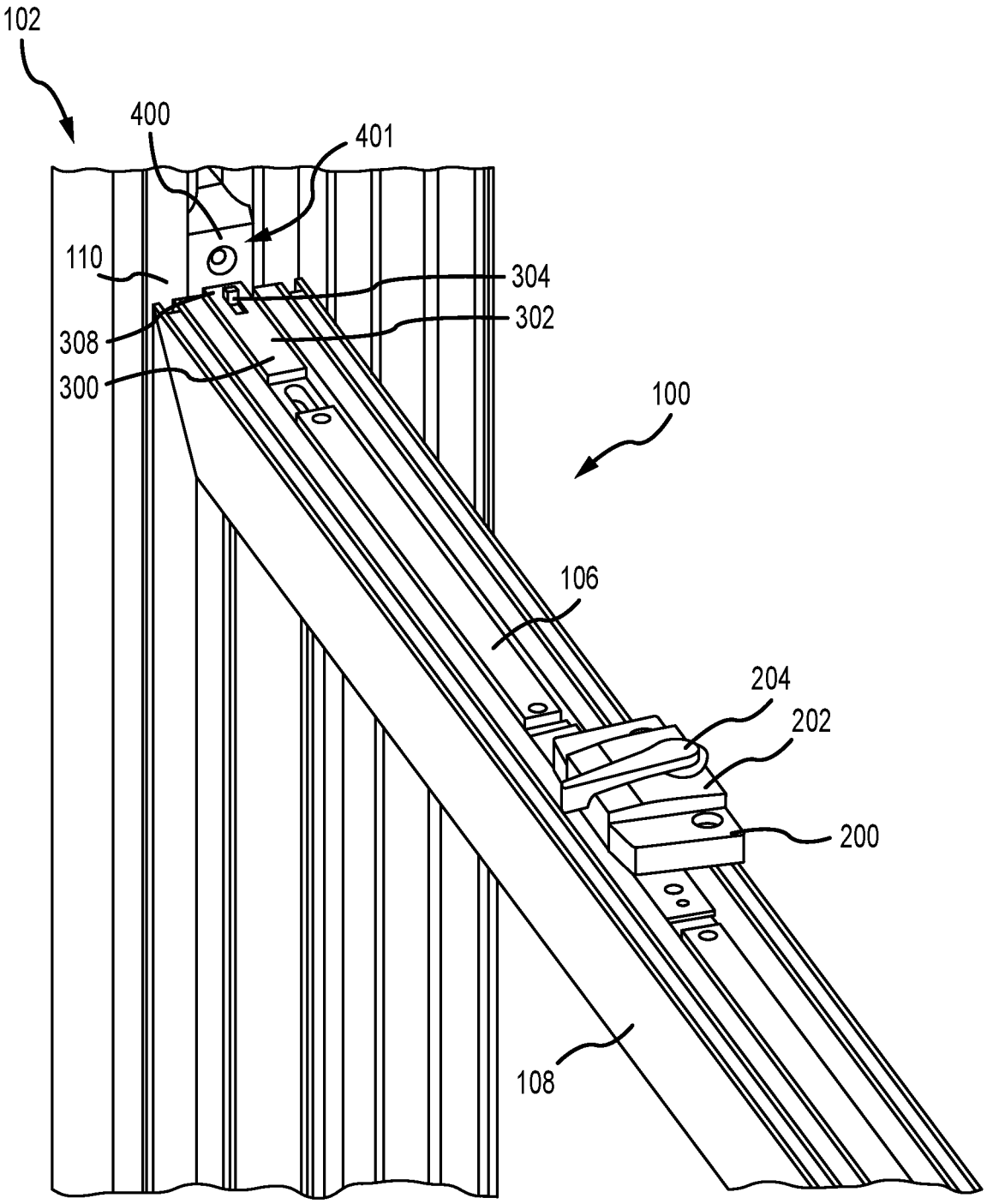
FIG. 11 is a perspective view of the window lock system with the sash lock in the unlocked position and the tilt latch in the extended position.

FIG. 11 is a perspective view of the window lock system 100 with the sash lock 200 in the unlocked position (e.g., FIG. 3) and the tilt latch 300 in the extended position (e.g., FIG. 7). When the sash lock 200 is in the unlocked position (e.g., via rotation of the lever 204), the cam 206 (shown in FIG. 10) retracts into the housing 202 and disengages with the corresponding window keeper on the second sash (not shown). This disengagement between the cam 206 and the window keeper allows vertical sliding movement of the window sash 108 so that the window sash 108 can open and close. However, when the sash lock 200 is in the unlocked position, the drive bar 106 is still in its extended position so that the first end 308 of the tilt latch 300 maintains its projection from the side surface of the window sash 108 and into the window jamb 110 adjacent the front surface 401. As such, the bolt 304 in the extended position engages with the WOCD keeper 400 to define the opening limit of the window sash 108 or the window jamb 110 itself when a keeper is not present and prevents the window sash 108 from tilting.

As illustrated in FIG. 11 the WOCD keeper 400 is still engaged by the tilt latch 300 and the window opening control device is engaged. This prevents the window sash 108 from opening past the limit defined by the elongated slot 402 (shown in FIG. 10) of the keeper 400. Because the distal end of the bolt 304 is engaged with the slot of the WOCD keeper 400, a limited window opening is only allowed and the top end of the elongated slot defines the upper limit of the opening of the window sash 108 allowed by the window lock system 100. In the example, the top end of the elongated slot forms a hard stop element with the bolt 304 such that the bolt 304 cannot bypass the hard stop without further action by the window operator. This hard stop is formed when the tilt latch 300 is in the extended position (as shown in FIG. 11) and when the sash lock 200 is in either the locked or unlocked position. Additionally, the hard stop is formed when the tilt latch 300 is in the extended position and when the sash lock 200 is in the tilt position because the bolt 304 still extends far enough from the window sash 108 to engage with the keeper 400. In an aspect, the top end of the elongated slot is formed as an approximate 90° corner and the top surface of the distal end of the bolt 304 is a substantially planar surface so that the bolt 304 cannot be automatically depressed when lifting the window sash 108 in a vertical motion.

Figure 12:
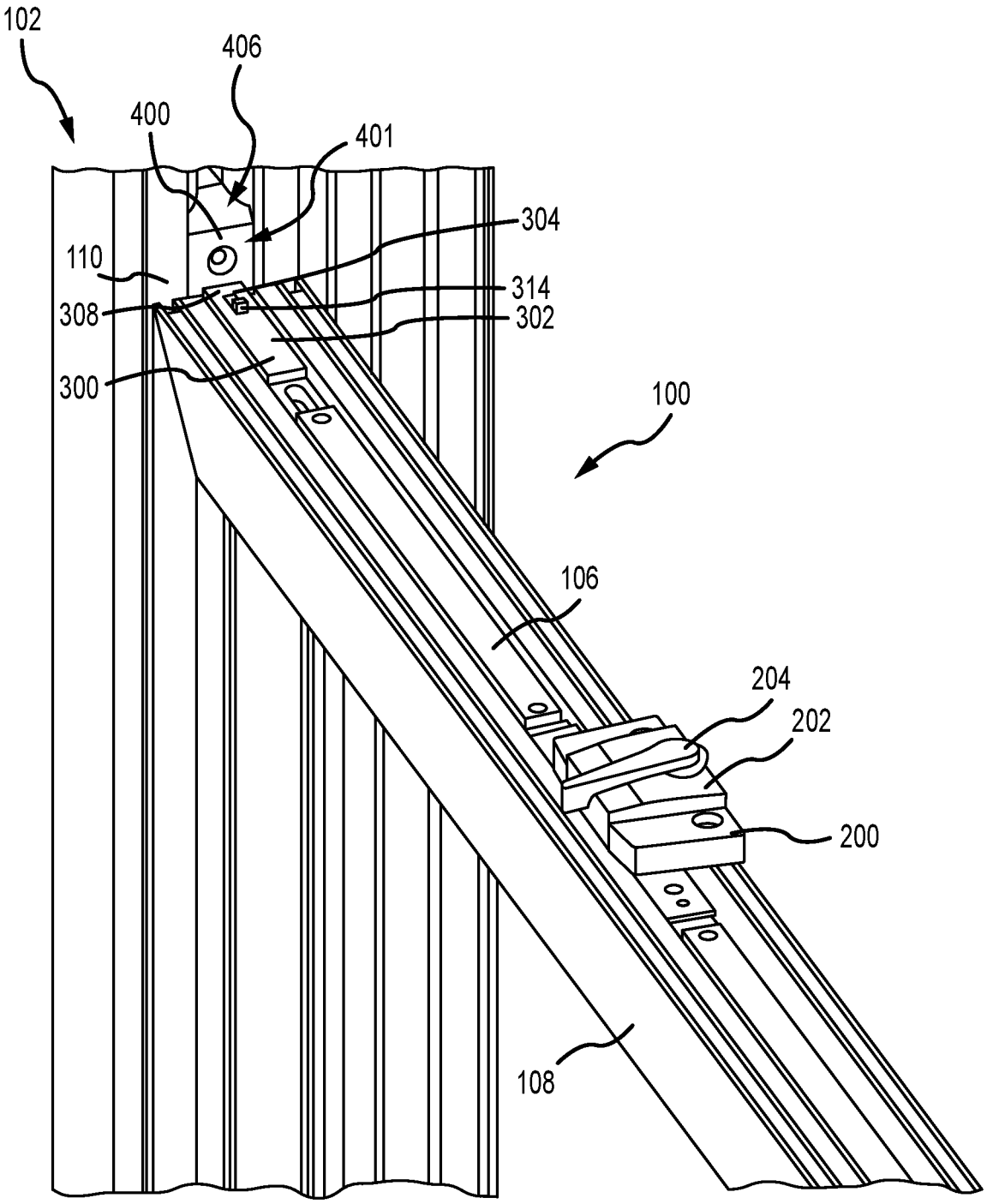
FIG. 12 is a perspective view of the window lock system with the sash lock in the unlocked position and the tilt latch in the retracted bypass position.

FIG. 12 is a perspective view of the window lock system 100 with the sash lock 200 in the unlocked position (e.g., FIG. 3) and the tilt latch 300 in the retracted bypass position (e.g., FIG. 8). When the sash lock 200 is in the unlocked position, the cam 206 (shown in FIG. 10) retracts into the housing and disengages with the corresponding window keeper on the second sash (not shown) as described above and so as to allow opening and closing of the window sash 108. However, when the sash lock 200 is in the unlocked position, the drive bar 106 is still in its extended position so that the first end 308 of the housing 302 maintains its protrusion from the side surface of the window sash 108 and the tilt latch 300 engages with the window jamb 110 to prevent tilting of the window sash 108. To enable the window sash 108 overcome the WOCD keeper 400 and open past the keeper defined limit, the bolt 304 is manually moved to the retracted bypass position by the window operator. When the bolt 304 is in the retracted bypass position, the distal end of the bolt 304 is retracted towards the first end 308 of the housing 302 (e.g., via the projection 314) and disengages with the elongated slot of the WOCD keeper 400. This allows the window sash 108 to defeat the WOCD keeper 400 and the tilt latch 300 to travel beyond the keeper 400 while still be prevented from tilting because the first end 308 is received within the window jamb.

When the tilt latch 300 is in the retracted bypass position, the distal end of the bolt 304 still protrudes from the first end 308 of the housing, however, the tilt latch 300 is spaced apart from the WOCD keeper 400 by at least this distance so that the WOCD keeper 400 can be bypassed and allow the window sash 108 to slide relative to the keeper 400. In the example, to bypass the WOCD keeper 400 two distinct movements by the window operator are needed, one for each of the left and right side tilt latches 300 and sliding the bolts 304 towards the retracted bypass position. This operation enables the window sash 108 to open and the tilt latch 300 to travel beyond the keeper 400.

Once the WOCD keeper 400 is bypassed and the tilt latch 300 is above the keeper, the bolt 304 remains in the retracted bypass position (shown in FIG. 8). The retracted position is automatically held because of the biasing mechanism 312 (shown in FIG. 8) and as described above. However, the sash lock 200 remains in the unlocked position, and as such, the drive bars 106 position the first end 308 of the housing 302 so that it projects from the side surface of the window sash 108 and the window sash 108 is prevented from tilting, while still allowing sliding movement. In the example, the bolt 304 has an oblique bottom surface that is configured to engage with an upper ramp surface 406 on the WOCD keeper 400 so that when closing the window sash 108, the bolt 304 can automatically be moved into the reset position (shown in FIG. 9) via the structure of the keeper 400 when the tilt latch 300 slides past. In one example, the structure of the keeper that enables this operation is described further below in reference to FIGS. 14 and 15. By resetting the position of the bolt 304 with the keeper 400, the extended position (shown in FIG. 7) of the bolt 304 is enabled to be automatically induced from the retracted bypass position and automatically reengage the WOCD keeper 400. As such, the window operator does not need to manually move the tilt latch 300 into the reset position when closing the window sash 108.

In the example, when bypassing the WOCD keeper 400, the bolt 304 of the tilt latch 300 is described as being engaged with the elongated slot in the extended position, manually moved to the retracted bypass position to bypass the WOCD keeper 400, and then automatically held in the retracted bypass position. When the window sash 108 is closed, the bolt 304 is moved from the retracted bypass position towards the reset position, automatically via the keeper 400, and then the bolt 304 is automatically reengaged with the WOCD keeper 400 in the extended position. This functionality is enabled because of the cyclic features of the biasing mechanism 312 (shown in FIGS. 7-9) of the bolt 304. The automatic movement of the bolt 304 from the retracted bypass position towards the extended position is induced by the ramp surface 406 depressing the bolt 304 so as to reset the position of the bolt 304. In one example, the tip of the bolt 304 may be tapered so as to facilitate this movement. In another example, the WOCD keeper 400 may be substantially symmetrical with a ramp surface on both the top and bottom side so that the keeper 400 can be install on either side of the window jamb 110.

Figure 13:
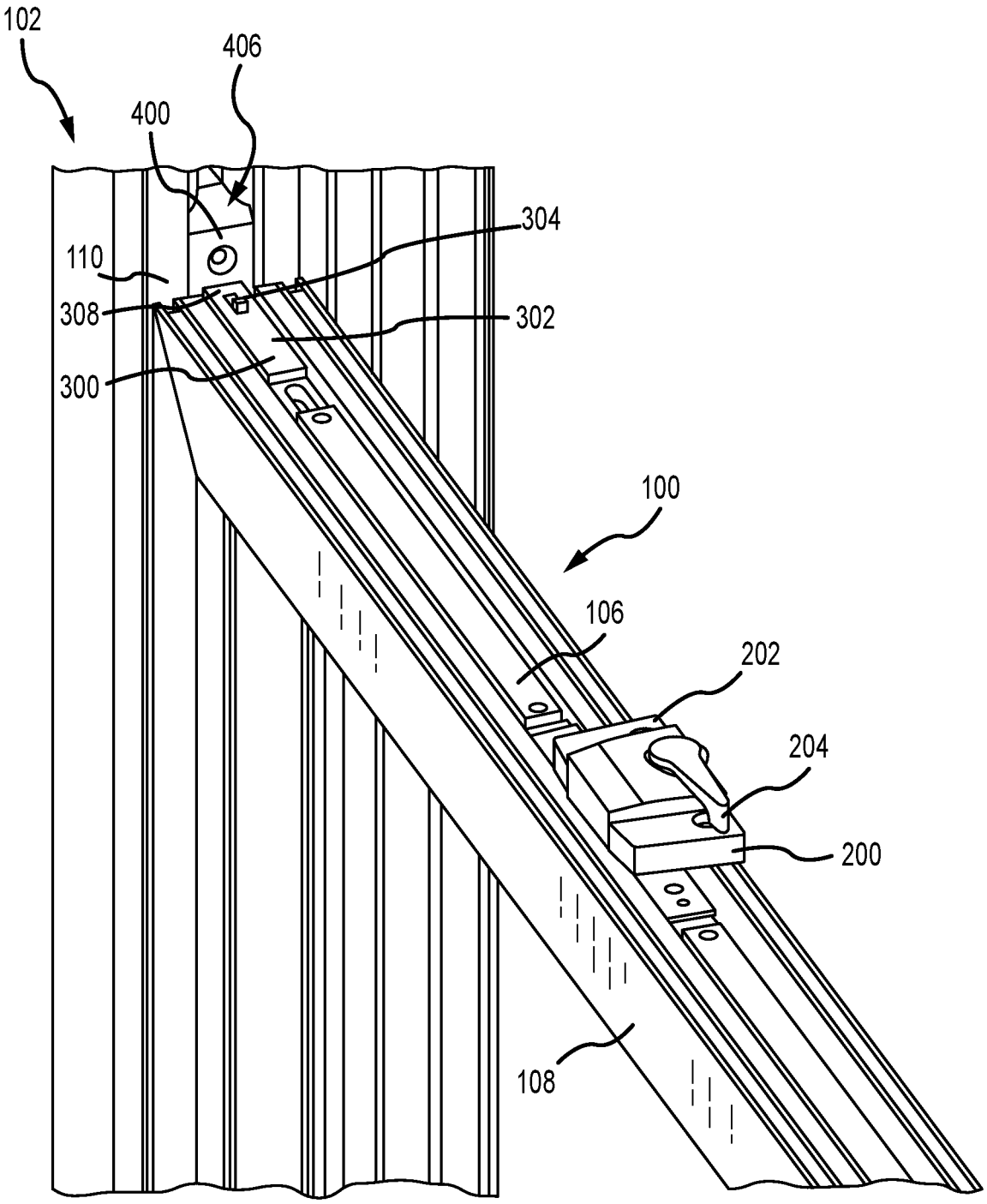
FIG. 13 is a perspective view of the window lock system with the sash lock in the tilt position and the tilt latch in the retracted bypass position.

FIG. 13 is a perspective view of the window lock system 100 with the sash lock 200 in the tilt position (shown in FIG. 5) and the tilt latch 300 in the retracted bypass position (shown in FIG. 8). When the sash lock 200 is in the tilt position via rotation of the lever 204, the cam 206 (shown in FIG. 10) remains retracted with the housing 202. Additionally, when the sash lock 200 is in the tilt position, the drive bar 106 is in a retracted position so that the first end 308 of the tilt latch 300 is pulled within the side surface of the window sash 108 and disengages with the window jamb 110. Additionally, when the tilt latch 300 is in the retracted bypass position, the distal end of the bolt 304 also disengages with the window jamb 110 although it is still protruding partially from the first end 308. Due to the sliding movement of the tilt latch 300 and retraction within the side surface of the window sash 108, the retraction distance of the first end 308 is greater than the projection distance of the distal end of the bolt 304 and the window sash 108 can be tilted because the distal end is not in a path of engagement with the window jamb 110. In an aspect, when the bolt 304 of the tilt latch 300 is in the extended position (shown in FIG. 7), the retraction distance of the first end 308 of the housing 302 is not sufficient to overcome the projection distance of the distal end of the bolt 304 and the tilt latch 300 still prevents the window sash 108 from tilting or defeating the WOCD function.

It should be appreciated that while FIGS. 10-13 illustrate and describe the sash lock 200, the tilt latch 300, and the WOCD keeper 400 operating in conjunction with one another, any one of the components or any pair of the components may be used without the other(s) in the tilt window 102.

Figure 14:
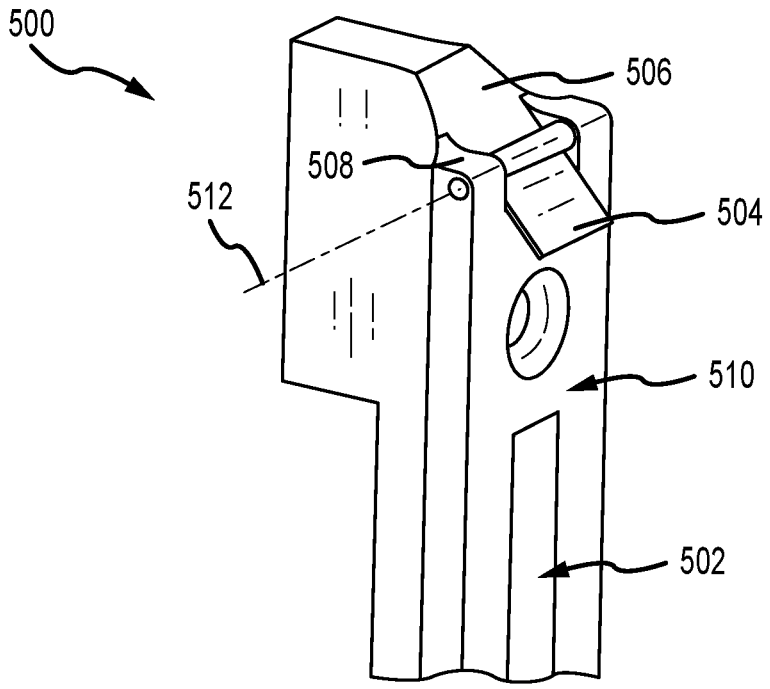
FIGS. 14 and 15 are perspective views of a keeper for use with the window lock system.
Figure 15:
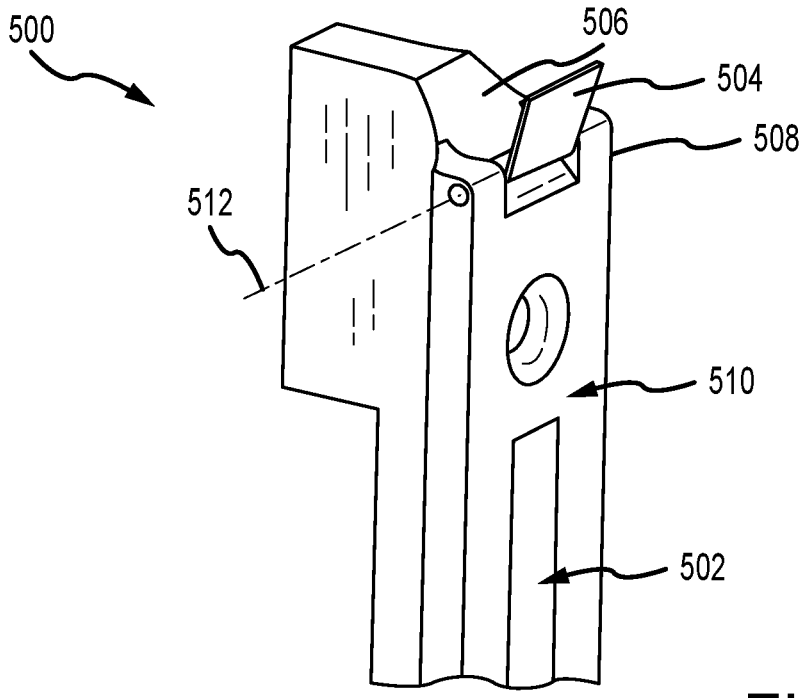

FIGS. 14 and 15 are perspective views of a WOCD keeper 500 for use with the window lock system 100 described above. Referring concurrently to FIGS. 14 and 15 and similar to the keeper 400 described in FIGS. 10-13, the WOCD keeper 500 is configured to mount within the window jamb and has an elongated slot 502 that is sized and shaped to at least partially receive the bolt 304 of the tilt latch 300 (shown in FIGS. 6-9). In this example, however, a swinging gate 504 is mounted proximate a ramp 506. The gate 504 is configured to selectively engage with the bolt 304 of the tilt latch 300 (shown in FIGS. 7-9) and move the bolt 304 from the retracted bypass position towards the reset position. A pair of tabs 508 are disposed proximate a front surface 510 and the ramp 506, and the gate 504 is coupled to the tabs 508. The gate 504 is rotatable around a rotation axis 512 between at least a closed position shown in FIG. 14 and an open position shown in FIG. 15. The gate 504 is shaped and sized to engage with the bolt 304 of the tilt latch 300 and depress the bolt 304 so as to cycle between latch positions in a top-to-bottom sliding direction only. In a bottom-to-top sliding direction, the gate 504 does not depress the bolt 304, and thus, the position of the bolt 304 does not change. The gate 504 is biased so as to automatically return to the closed position (shown FIG. 14). In the example, the gate 504 returning towards the closed position is driven by gravity. In other example, the gate 504 may have a biasing member like a spring (not shown).

In operation, when the gate 504 is in the closed position (shown FIG. 14), a distal end of the gate 504 projects from the front surface 510 of the WOCD keeper 500 and its position is held in place by the ramp 506 such that further rotation of the gate 504 is restricted. As such, when the tilt latch 300 slides past the gate 504 in a downward motion, the gate 504 holds its position and more easily contacts the bolt 304 to induce the depression and the reset of the bolt 304 within the tilt latch 300. In an aspect, the angle of the gate 504 in the closed position is substantially parallel to the ramp 506.

When the tilt latch 300 slides past the gate 504 in an upwards direction, the bolt 304 contacts the other side of the gate 504 and moves the gate 504 towards the open position (shown in FIG. 15), because free rotation around the rotation axis 512 in an upwards direction is allowed. The open position allows the tilt latch 300 to move past the gate 504 without depressing and resetting the bolt 304 so that its configuration does not change.

The materials utilized in the manufacture of the lock and drive components described herein may be those typically utilized for lock manufacture, e.g., zinc, steel, aluminum, brass, stainless steel, etc. Molded plastics, such as PVC, polyethylene, etc., may be utilized for the various components. Material selection for most of the components may be based on the proposed use of the locking system. Appropriate materials may be selected for mounting systems used on particularly heavy panels, as well as on hinges subject to certain environmental conditions (e.g., moisture, corrosive atmospheres, etc.).

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A window lock system comprising:

a sash lock comprising:

a first housing configured to be mounted on a first window sash and defining a longitudinal axis;

a lever rotatably coupled to the first housing and defining a rotation axis substantially orthogonal to the longitudinal axis;

a cam at least partially disposed within the first housing and engaged with the lever so as to rotate around the rotation axis;

a slide plate coupled to the cam and disposed within the first housing, wherein the slide plate is slidable along the longitudinal axis; and at least one actuator coupled to the slide plate and movable along the longitudinal axis;

at least one tilt latch comprising:

a second housing configured to be slidably mounted on the first window sash, wherein the second housing has a first end and an opposite second end that extend in a direction along the longitudinal axis; and a bolt slidingly coupled to the first end of the second housing; and a drive bar coupling the at least one actuator and the second end of the second housing such that movement of the at least one actuator corresponds to movement of the second housing along the longitudinal axis, wherein the sash lock is movable between at least a locked position that engages at least a portion of the cam with a keeper on a second window sash, an unlocked position that disengages the cam from the keeper on the second window sash, and a tilt position by rotating the lever about the rotation axis and driving rotation of the cam and sliding of the slide plate, wherein when the sash lock is in the tilt position, the at least one actuator retracts relative to the first housing and via the drive bar retracts the first end of the second housing of the at least one tilt latch relative to a side surface of the first window sash.

2. The window lock system of claim 1, wherein when the sash lock is moved between the locked position and the unlocked position, the at least one actuator does not move relative to the first housing.

3. The window lock system of claim 1, wherein when the sash lock is moved between the locked position and the unlocked position, the slide plate slides along the longitudinal axis.

4. The window lock system of claim 1, wherein the sash lock further comprises an elongate channel and a biasing member, wherein the at least one actuator is disposed at least partially within the elongate channel and is biased relative to the elongate channel, and wherein the sash lock is biased towards the unlocked position from the tilt position.

5. The window lock system of claim 1, wherein the sash lock further comprises an elongate channel and a biasing member, wherein the at least one actuator is disposed at least partially within the elongate channel and is biased relative to the elongate channel, and wherein moving the sash lock from the unlocked position towards the tilt position at least partially overcomes the biasing member.

6. The window lock system of claim 1, wherein the slide plate comprises a first elongate slot and a second elongate slot, the first elongate slot being orthogonal to the second elongate slot, and wherein a first post is slidably received at least partially within the first elongate slot and coupled to the cam, and a second post is slidably received at least partially within the second elongate slot and coupled to the at least one actuator.

7. The window lock system of claim 1, wherein the at least one actuator comprises a first actuator and a second actuator, wherein an end of each of the first and second actuators comprise a rack coupled together by a rotatable cog.

8. A window lock system comprising:

a sash lock configured to be mounted on a first window sash, the sash lock comprising:

a first housing;

a cam configured to selectively engage a keeper of a second window sash;

at least one actuator; and a lever configured to drive movement of the cam and the at least one actuator relative to the first housing;

at least one tilt latch configured to be slidably mounted on the first window sash, the at least one tilt latch comprising:

a second housing having a first end and an opposite second end defining a longitudinal axis, wherein the first end is mounted proximate a side surface of the first window sash;

a biasing mechanism disposed within the second housing; and a bolt at least partially disposed within the second housing proximate the first end and coupled to the biasing mechanism, wherein the bolt has a distal end configured to extend and retract along the longitudinal axis relative to the first end of the second housing; and a drive bar coupling the at least one actuator and the second end of the second housing such that movement of the at least one actuator corresponds to movement of the second housing relative to the first housing.

9. The window lock system of claim 8, wherein movement of the at least one actuator drives sliding movement of the second housing of the at least one tilt latch relative to the side surface of the first window sash via the drive bar.

10. The window lock system of claim 8, wherein the bolt of the at least one tilt latch is movable between at least an extended position, a retracted bypass position, and a reset position, and wherein the bolt is configured to be retained in either the extended position or the retracted bypass position.

11. The window lock system of claim 10, wherein the at least one tilt latch further comprises a tilt latch cam disposed within the second housing, wherein the bolt has a finger opposite of the distal end and the second housing has a support, and wherein in the extended position the tilt latch cam engages with the finger and in the retracted bypass position the tilt latch cam engages with the support.

12. The window lock system of claim 11, wherein the tilt latch cam is rotatable around the longitudinal axis.

13. The window lock system of claim 8, wherein an elongated opening is defined in the second housing proximate the first end and the bolt has a projection at least partially slidingly disposed within the elongated opening, and wherein the projection is accessible from outside of the second housing.

14. The window lock system of claim 8, further comprising a second keeper configured to mount within a window jamb and selectively engage with the at least one tilt latch.

15. The window lock system of claim 8, wherein an elongated opening is defined within the second housing proximate the first end and extending along the longitudinal axis, wherein the bolt comprises a projection slidingly received at least partially within the elongated opening of the second housing and extending outside of the second housing, wherein the distal end of the bolt is configured to move between at least an extended position and a retracted bypass position along the longitudinal axis relative to the first end of the second housing by the projection, and wherein the window lock system further comprises a second keeper configured to mount within a window jamb, the second keeper comprising an elongated slot configured to selectively receive at least a portion of the bolt and define at least partially an opening limit of the first window sash when the at least one tilt latch is engaged with the second keeper.

16. The window lock system of claim 15, wherein the distal end of the bolt is engaged with the elongated slot in only the extended position.

17. The window lock system of claim 16, wherein when the bolt is in the retracted bypass position, the first end of the second housing is configured to slide within the first window sash to disengage the bolt from the window jamb so that the first window sash can tilt.

18. The window lock system of claim 15, wherein the second keeper includes a gate configured to selectively engage with the bolt and automatically move the bolt from the retracted bypass position towards the extended position when the at least one tilt latch slides across the gate.

19. The window lock system of claim 15, wherein the distal end of the bolt is also configured to move into a reset position, wherein in the reset position, the distal end is fully disposed within the second housing.

* * * * *